US006770170B2

(12) United States Patent
Covarrubias

(10) Patent No.: US 6,770,170 B2
(45) Date of Patent: Aug. 3, 2004

(54) PAPERMAKING PULP INCLUDING RETENTION SYSTEM

(75) Inventor: Rosa Maria Covarrubias, Bartlett, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 09/803,225

(22) Filed: Mar. 9, 2001

(65) Prior Publication Data

US 2002/0100568 A1 Aug. 1, 2002

Related U.S. Application Data

(60) Provisional application No. 60/204,708, filed on May 16, 2000.

(51) Int. Cl.[7] ..... D21H 11/00

(52) U.S. Cl. ..... 162/164.1; 162/164.3; 162/164.6; 162/168.1; 162/168.2; 162/168.3; 162/181.1; 162/181.4; 162/181.5; 162/183

(58) Field of Search ..... 162/181.1, 181.4, 162/181.5, 183, 168.2, 168.3, 168.1, 164.1, 164.3, 164.6

(56) References Cited

U.S. PATENT DOCUMENTS

| | | | | | |
|---|---|---|---|---|---|
| 2,915,475 | A | | 12/1959 | Bugosh | 252/313 |
| 2,917,426 | A | * | 12/1959 | Bugosh | 162/181.1 |
| 3,234,075 | A | * | 2/1966 | Braitberg | 162/181.1 |
| 4,753,710 | A | | 6/1988 | Langley et al. | 162/164.3 |
| 4,798,653 | A | | 1/1989 | Rushmere | 162/168.3 |
| 4,894,119 | A | | 1/1990 | Baron, Jr. et al. | 162/168.2 |
| 4,913,774 | A | | 4/1990 | Goguelin | 162/158 |
| 5,015,334 | A | | 5/1991 | Derrick | 162/168.1 |
| 5,169,497 | A | * | 12/1992 | Sarkar et al. | 162/72 |
| 5,221,435 | A | * | 6/1993 | Smith | 162/181.1 |
| 5,356,800 | A | | 10/1994 | Jaquess | 435/188 |
| 5,496,440 | A | * | 3/1996 | Carre et al. | 162/181.4 |
| 5,507,914 | A | * | 4/1996 | Sarkar et al. | 162/183 |
| 5,571,379 | A | | 11/1996 | Derrick | 162/168.1 |
| 5,942,087 | A | * | 8/1999 | Pruszynski | 162/183 |

FOREIGN PATENT DOCUMENTS

| | | |
|---|---|---|
| WO | WO 97/41063 | 11/1997 |
| WO | WO 99/43780 | 9/1999 |
| WO | WO 00/53532 | 9/2000 |

OTHER PUBLICATIONS

International Search for PCT/US01/07951 mailed on May 10, 2001.

* cited by examiner

*Primary Examiner*—Peter Chin
(74) *Attorney, Agent, or Firm*—Kilyk & Bowersox, P.L.L.C.

(57) ABSTRACT

Methods of making paper or paperboard are described. According to one method, fibrous cationic colloidal alumina microparticles and a polymer are introduced to a papermaking pulp to form a treated pulp having improved retention properties. The fibrous cationic colloidal alumina microparticles are preferably a fibrous cationic acetate salt of boehmite alumina having a zeta potential of greater than about 25 and a weight ratio of alumina to acetate of less than about 4. The polymer can be a cationic polymer, a nonionic polymer, an amphoteric polymer under cationic conditions, or combinations thereof. The pulp may also be treated with at least one coagulant, at least one flocculant, at least one cationic starch, at least one cellulytic enzyme, and/or other conventional papermaking pulp additives. The resulting pulp is formed into a sheet of pulp and then drained to form a paper or paperboard. Other papermaking processes are also described as is a papermaking apparatus for carrying out the methods. Paper and paperboard containing dried pulp that has been treated with fibrous cationic colloidal alumina microparticles and polymer are also described.

22 Claims, 26 Drawing Sheets

PAPERMAKING PULP INCLUDING RETENTION SYSTEM

CROSS REFERENCE TO RELATED APPLICATION

This application claims the benefit under 35 U.S.C. §119 (e) of prior U.S. Provisional Patent Application No. 60/204,708 filed May 16, 2000, which is incorporated in its entirety by reference herein.

BACKGROUND OF THE INVENTION

The present invention relates to papermaking pulps, papermaking processes employing the pulps, and paper and paperboard products made from the pulps. More particularly, the present invention relates to treating papermaking pulp with at least one microparticle-containing retention aid system.

Microparticles and other particulate materials have been added to papermaking pulps as retention aids. For example, U.S. Pat. No. 4,798,653 to Rushmere, which is incorporated herein in its entirety by reference, describes a papermaking stock including cellulose fibers and a two-component combination of an anionic polyacrylamide and a cationic colloidal silica sol.

One problem with microparticle sols that have been employed in papermaking pulps has been with instability. Because of the instability of sols used in connection with papermaking pulps, the sols are often made on-site for immediate delivery to a papermaking process. A need exists for a stable microparticle sol retention aid for use in papermaking processes which can be formed off-site, exhibits a long shelf life, and can be shipped to a papermaking plant for immediate or future use in a papermaking process.

A need also exists for a papermaking pulp that exhibits even better retention of fines and even better resistance to shear forces during a papermaking process. A need also exists for a papermaking pulp that produces a paper or paperboard product with improved strength characteristics.

SUMMARY OF THE INVENTION

The present invention relates to the use of a combination of fibrous cationic colloidal alumina microparticles and at least one polymer as a retention aid system for a papermaking pulp or stock. The fibrous cationic colloidal alumina microparticles can preferably be a cationic fibrous acetate salt of boehmite alumina. The fibrous product can be obtained by stirring a slurry of water and basic alumina acetate to ensure substantially complete mixing thereof, and then reacting the slurry to produce a fibrous cationic acetate salt of boehmite alumina preferably having a zeta potential, when measured in deionized water, of greater than about 25 and preferably having a weight ratio of alumina to acetate of less than about 4. The surface area to volume ratio of the salt is preferably about 50% or greater. The polymer can be a cationic polymer, a nonionic polymer, or an amphoteric polymer used under cationic conditions. The polymer is preferably a synthetic nitrogen-containing cationic polymer, for example, a cationic polyacrylamide. If nonionic, the polymer can be, for example, a nonionic polyacrylamide or a polyethylene oxide.

The present invention also relates to papermaking pulp or stock that includes fibrous cationic colloidal alumina microparticles in combination with at least one polymer as a retention aid system.

Exemplary fibrous boehmite alumina microparticles suitable for use in the retention aid system of the present invention include the fibrous alumina products obtainable by the processes described in U.S. Pat. No. 2,915,475 to Bugosh, and those described in WO 97/41063, which are both incorporated herein in their entireties by reference. The fibrous cationic colloidal alumina microparticles are preferably very stable, preferably have a long shelf life, and preferably can be made off-site and then shipped to a paper mill for future use. The pulps or stocks of the present invention may also contain or be treated with at least one coagulant, at least one flocculant, at least one filler, at least one polyacrylamide, at least one cationic starch, at least one enzyme, and/or other conventional papermaking pulp additives. The resulting pulp or stock is then formed into a wet sheet of pulp or stock having improved retention properties compared to a wet sheet made of conventionally treated pulp. After drainage and drying, the resulting paper or paperboard preferably exhibits excellent opaqueness and/or other physical properties.

It is to be understood that both the foregoing general description and the following detailed description are exemplary and explanatory only and are only intended to provide a further explanation of the present invention, as claimed. The accompanying drawings, which are incorporated in and constitute a part of this application, illustrate several exemplary embodiments of the present invention and together with description, serve to explain the principles of the present invention.

DETAILED DESCRIPTION OF THE PRESENT INVENTION

Figure 1:
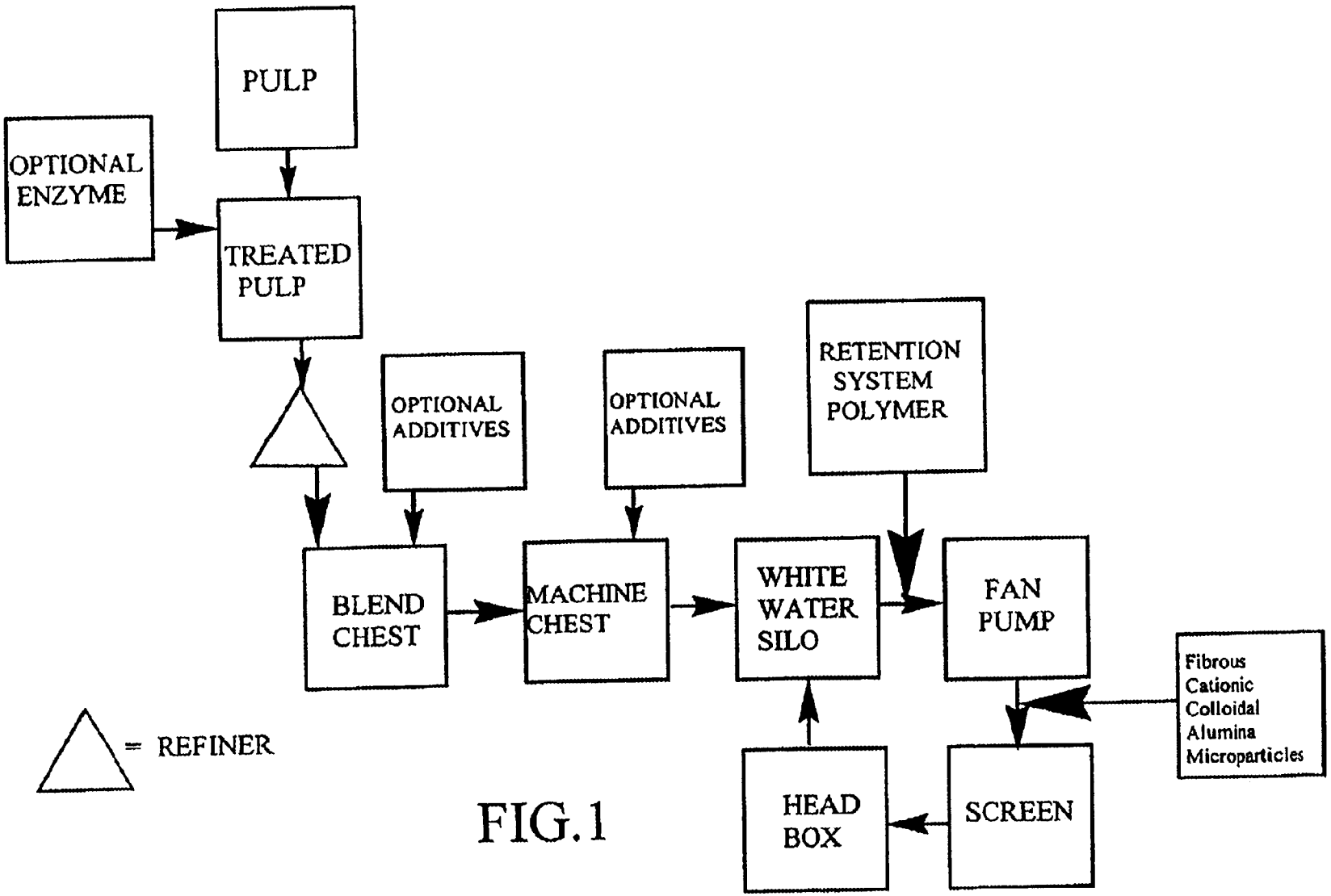
FIG. 1 is a flow chart showing a papermaking process according to an embodiment of the present invention.

The present invention relates to the use of a combination of fibrous cationic colloidal alumina microparticles and a polymer as a retention aid system for a papermaking pulp. More than one type of microparticle can be used and more than one type of polymer can be used. Paper and paperboard products made according to the method preferably exhibit excellent opaqueness and/or other desirable physical properties. Sheets of pulp from which the paper and paperboard products are made preferably exhibit excellent drainage and/or excellent retention of pulp fines.

The fibrous cationic colloidal alumina microparticles can preferably be a cationic fibrous acetate salt of boehmite alumina. The fibrous product can be obtained by stirring a slurry of water and basic alumina acetate to ensure substantially complete mixing thereof, and then reacting the slurry to produce a fibrous cationic acetate salt of boehmite alumina. The fibrous microparticles preferably have a zeta potential of greater than about 25 and/or preferably have a weight ratio of alumina to acetate of less than about 4. The surface area to volume ratio of the salt is preferably about 50% or greater.

The fibrous cationic colloidal alumina microparticles can be added in any amount sufficient to improve the retention of fines when the pulp or stock is formed into a wet sheet or web. Preferably, the fibrous cationic colloidal alumina microparticles are added in an amount of at least about 0.05 pound per ton of paperstock, based on the dried solids weight of both the microparticles and the paperstock, and more preferably in an amount of at least about 0.2 pound per ton of paperstock. Even more preferably, the fibrous cationic colloidal alumina microparticles are added in an amount of from about 0.3 pound per ton of paperstock to about 5.0 pounds per ton of paperstock, for example, from about 0.3 pound to about 1.0 pound per ton, based on dried solids weight of the paperstock. For purposes of this patent application, the terms "pulp", "stock", and "paperstock" are used interchangeably.

Exemplary fibrous boehmite alumina microparticles suitable for use in the retention aid system of the present invention include the fibrous alumina products described in U.S. Pat. No. 2,915,475 to Bugosh, and those described in WO 97/41063, which are both incorporated herein in their entireties by reference. The fibrous cationic colloidal alumina microparticles preferably have one or more of the following benefits: they are very stable; they have a long shelf life; and/or they can be made off-site and then shipped to a paper mill for future use. The pulps or stocks of the present invention may also contain or be treated with at least one coagulant, at least one flocculant, at least one filler, at least one polyacrylamide, at least one cationic starch, at least one enzyme, and/or other conventional papermaking pulp additives, or combinations thereof. The resulting pulp or stock is then formed into a wet sheet of pulp or stock and preferably has improved retention properties compared to a wet sheet made with no microparticles or polymer. After drainage and drying, the resulting paper or paperboard preferably exhibits excellent opaqueness and/or other physical properties.

The polymer is preferably added to the papermaking pulp after addition of the fibrous cationic colloidal alumina microparticles, though any order of addition can be used. Preferably, the polymer can be any polymer which does not adversely affect the formation of pulp or paper. Preferably, the polymer is a medium to high molecular weight synthetic polymer, for example, a cationic nitrogen-containing polymer such as a cationic polyacrylamide. The polymer can be cationic, nonionic, or amphoteric. If amphoteric, the polymer is preferably used under cationic conditions. At least one other polymer of any kind can be used in addition to the polymers recited above so long as the at least one other polymer does not substantially adversely affect the retention properties of the present invention. The at least one other polymer can preferably be a polyamidoamineglycol (PAAG) polymer.

The polymer preferably has a molecular weight in the range of from about 100,000 to about 25,000,000, and more preferably from about 1,000,000 to about 18,000,000, though other molecular weights are possible.

The polymer can preferably be a high molecular weight linear cationic polymer or a crosslinked polyethylene oxide. Exemplary high molecular weight linear cationic polymers and shear stage processing suitable for use in the pulps and methods of the present invention are described in U.S. Pat. No. 4,753,710 and 4,913,775, which are both incorporated herein in their entireties by reference.

The polymer is preferably added before the various significant shear steps of the papermaking process. The fibrous cationic colloidal alumina microparticles can be added before or after the various significant shear steps of the papermaking process. According to some embodiments of the present invention, the polymer can be added before the fibrous cationic colloidal alumina microparticles and before at least one significant shear step in the papermaking process. If the polymer is added before the fibrous cationic colloidal alumina microparticles, the microparticles can be added before or after a final shear step of the papermaking process. Although it is preferable to add the polymer to the papermaking pulp before the last shear point in the papermaking process, the polymer can be added after the last shear point.

The fibrous cationic colloidal alumina microparticles preferably form bridges or networks between various particles. The polymer is preferably partially attached (e.g., adsorbed) onto the surfaces of particles within the stock and can provide sites of attachment.

Aqueous cellulosic papermaking pulp or stock can be treated by first adding the polymer to the pulp or stock, followed by subjecting the paper stock to high shear conditions, followed by the addition of the fibrous cationic colloidal alumina microparticles prior to sheet formation. As discussed above, the polymer can be cationic, nonionic, or amphoteric under cationic conditions. Alternatively, the polymer can be added simultaneously with the fibrous cationic colloidal alumina microparticles.

Preferred cationic polyacrylamides for use as the retention system polymer are described in more detail below. If a cationic polyacrylamide is used as the cationic polymer, the cationic polyacrylamide can have a molecular weight in excess of 100,000, and preferably has a molecular weight of from about 1,000,000 and 18,000,000. The combination of the polymer and the fibrous cationic colloidal alumina microparticles preferably provides a suitable balance between freeness, dewatering, fines retention, good paper formation, strength, and resistance to shear.

The polymer composition of the retention system is added in an amount effective to preferably improve the drainage or retention of the pulp compared to the same pulp but having no polymer present. The polymer is preferably added in an amount of at least about 0.05 pound of polymer per ton of paperstock (or pulp), based on the weight of dried solids of both the polymer and the paperstock, and more preferably in an amount of at least about 0.1 pound per ton of paperstock. The polymer can be added in an amount of from about 0.2 pound per ton of paperstock to about 2.5 pounds per ton of paperstock, based on the dried solids weight of the paperstock, though other amounts can be used.

If the polymer is a cationic polymer or an amphoteric polymer under cationic conditions, the polymer is preferably added in an amount of from about 5 grams to about 500 grams per ton of paperstock on a dry basis, more preferably from about 20 grams to about 200 grams, and even more preferably from about 50 grams to about 100 grams per ton of paperstock on a dry basis, though other amounts can be used.

If the polymer is cationic, any cationic polymer or mixture thereof can be used and preferably conventional cationic polymers commonly associated with papermaking can be used in the pulps or stocks of the present invention. Examples of cationic polymers include, but are not limited to, cationic starches and cationic polyacrylamide polymers, for example, copolymers of an acrylamide with a cationic monomer, wherein the cationic monomer may be in a neutralized or quaternized form. Nitrogen-containing cationic polymers are preferred. Exemplary cationic monomers which may be copolymerized with acrylamide to form preferred cationic polymers useful according to the present invention, include amino alkyl esters of acrylic or methacrylic acid, and diallylamines in either neutralized or quaternized form. Exemplary cationic monomers and cationic polyacrylamide polymers are described in U.S. Pat. No. 4,894,119 to Baron, Jr., et al., which is incorporated herein in its entirety by reference.

The polymer may also be a polyacrylamide formed from comonomers that include, for example, 1-trimethylammonium-2-hydroxypropylmethacrylate methosulphate. Other examples of cationic polymers, include, but are not limited to, homopolymers of diallylamine monomers, homopolymers of aminoalkylesters of acrylic acids, and polyamines, as described in U.S. Pat. No. 4,894,119. Co-polymers, ter-polymers, or higher forms of polymers may also be used. Further, for purposes of the present invention, a mixture of two or more polymers may be used.

In embodiments wherein the polymer contains a cationic polyacrylamide, nonionic acrylamide units are preferably present in the copolymer, preferably in an amount of at least about 30 mol % and generally in an amount of no greater than 95 mol %. From about 5 mol % to about 70 mol % of the polymer is preferably formed from a cationic comonomer.

The papermaking pulp or stock can be any conventional type, and, for instance, can contain cellulose fibers in an aqueous medium at a concentration of preferably at least about 50% by weight of the total dried solids content in the pulp or stock. The retention system of the present invention can be added to many different types of papermaking pulp, stock, or combinations of pulps or stocks. For example, the pulp may comprise virgin and/or recycled pulp, such as virgin sulfite pulp, broke pulp, a hardwood kraft pulp, a softwood kraft pulp, mixtures of such pulps, and the like.

The retention aid system can be added to the pulp or stock in advance of depositing the pulp or stock onto a papermaking wire. The pulp or stock containing the retention aid system has been found to exhibit good dewatering during formation of the paperweb on the wire. The pulp or stock also exhibits a desirable high retention of fiber fines and fillers in the paperweb products under conditions of high shear stress imposed upon the pulp or stock.

In addition to the retention aid system used in accordance with the present invention, the papermaking pulp or stock according to the present invention may further contains other types of microparticles, for example, a synthetic hectorite microparticle additive. One or more different types of secondary microparticle additives, different from the fibrous cationic colloidal alumina microparticles, may be added to the pulp at any time during the process. The secondary microparticle additive can be a natural or synthetic hectorite, bentonite, zeolite, non-acidic alumina sol, or any conventional particulate additives as are known to those skilled in the art. Exemplary synthetic hectorite microparticle additives include LAPONITE available from Laporte Industries, and the synthetic microparticles described in U.S. Pat. Nos. 5,571,379 and 5,015,334, which are incorporated herein in their entireties by reference. If included in the pulps or stocks of the present invention, a synthetic hectorite microparticle additive can be present in any effective amount, such as from about 0.1 pound per ton of paperstock, based on the dried solids weight of both the microparticles and the paperstock, to about 2.0 pounds per ton of paperstock. Preferably, if a synthetic hectorite microparticle is included, it is added to the pulp or stock in an amount of from about 0.3 pound on a dry basis per ton of paperstock to about 1.0 pound per ton of paperstock, based on dried solids weight of the paperstock, though other amounts can be used.

In addition to the fibrous cationic colloidal alumina microparticles retention aid system used in accordance with the present invention, the papermaking pulps or stocks according to the present invention may further contain a coagulant/flocculant retention system having a different composition than the retention system of the present invention.

The papermaking pulps of the present invention may also contain a conventional papermaking pulp-treating enzyme that has cellulytic activity. Preferably, the enzyme composition also exhibits hemicellulytic activity. Suitable enzymes and enzyme-containing compositions include those described in U.S. Pat. No. 5,356,800 to Jaquess, U.S. patent application No. 09/031,830 filed Feb. 27, 1998, and International Publication No. WO 99/43780, all incorporated herein in their entireties by reference. Other exemplary papermaking pulp-treating enzymes are BUZYME™ 2523 and BUZYME™ 2524, both available from Buckman Laboratories International, Inc., Memphis, Tenn. A preferred cellulytic enzyme composition preferably contains from about 5% by weight to about 20% by weight enzyme. The preferred enzyme composition can further contain polyethylene glycol, hexylene glycol, polyvinylpyrrolidone, tetrahydrofuryl alcohol, glycerine, water, and other conventional enzyme composition additives, as for example, described in U.S. Pat. No. 5,356,800. The enzyme may be added to the pulp in any conventional amount, such as in an amount of from about 0.001% by weight to about 0.100% by weight enzyme based on the dry weight of the pulp, for example, from about 0.005% by weight to about 0.05% by weight.

In a preferred embodiment of the present invention, an enzyme composition is included in the pulp or stock and contains at least one polyamide oligomer and at least one enzyme. The polyamide is present in an effective amount to stabilize the enzyme. Exemplary enzyme compositions containing polyamide oligomers and enzymes are described in International Published Application No. WO 99/43780, which is incorporated herein in its entirety by reference.

If an enzyme composition is included, it can include a combination of two or more different enzymes. The enzyme composition can include, for example, a combination of a lipase and a cellulose, and optionally can include a stabilizing agent. The stabilizing agent may be a polyamide oligomer as described herein.

One particular additive for use according to the methods of the present invention is a cationic starch. Cationic starch may be added to the pulp or stock of the present invention to form a starch treated pulp. Starch may be added at one or more points along the flow of papermaking pulp through the papermaking apparatus or system of the present invention. For instance, cationic starch can be added to a pulp at about the same time that the acidic aqueous alumina sol is added to the pulp. Preferably, if a cationic starch is employed, it is added to the pulp or combined with the pulp prior to introducing the fibrous cationic colloidal alumina microparticles to the pulp. The cationic starch can alternatively or additionally be added to the pulp after the pulp is first treated with an enzyme, a coagulant, or both. Preferred cationic starches include, but are not limited to, potato starches, corn starches, and other wet-end starches, or combinations thereof.

Conventional amounts of starch can be added to the pulp. An exemplary amount of starch that can be used according to the present invention is from about 5 to about 25 pounds per ton based on the dried solids weight of the pulp.

A biocide may be added to the pulp in accordance with conventional uses of biocides in papermaking processes. For example, a biocide may be added to the treated pulp in a blend chest after the pulp has been treated with the optional enzyme and polymer. Biocides useful in the papermaking pulps according to the present invention include biocides well known to those skilled in the art, for example, biocides available from Buckman Laboratories International, Inc., Memphis, Tenn., such as BUSAN™ biocides.

The pulps or stocks of the present invention may additionally be treated with one or more other components, including polymers such as anionic and non-ionic polymers, clays, other fillers, dyes, pigments, defoamers, pH adjusting agents such as alum, microbiocides, and other conventional papermaking or processing additives. These additives can be added before, during, or after introduction of the fibrous cationic colloidal alumina microparticles. Preferably, the fibrous cationic colloidal alumina microparticles are added after most, if not all, other additives and components are added to the pulp. Thus, the fibrous cationic colloidal alumina microparticles can be added to the papermaking pulp after the addition of enzymes, coagulants, flocculants, fillers, and other conventional and non-conventional papermaking additives.

The addition of the retention system in accordance with the present invention can be practiced on most, if not all, conventional papermaking machines.

A flow chart of a papermaking system for carrying out one of the methods of the present invention is set forth in FIG. 1. It is to be understood that the system shown is exemplary of the present invention and is in no way intended to restrict the scope of the invention. In the system of FIG. 1, an optional supply of enzyme composition at a desired concentration is combined with a flowing stream of papermaking pulp to form a treated pulp. The supply of pulp shown represents a flow of pulp, as for example, supplied from a pulp holding tank or silo. The supply of pulp shown in FIG. 1 can be a conduit, holding tank, or mixing tank, or other container, passageway, or mixing zone for the flow of pulp. The supply of enzyme composition can be, for example, a holding tank having an outlet in communication with an inlet of a treated pulp tank.

The pulp treated with the enzyme composition is passed from the treated pulp tank through a refiner and then through a blend chest where optional additives, for example, a biocide, may be combined with the treated pulp. The refiner has an inlet in communication with an outlet of the treated pulp tank, and an outlet in communication with an inlet of the blend chest.

According to the embodiment of FIG. 1, the pulp treated in the blend chest is passed from an outlet of the blend chest through a communication to an inlet of a machine chest where optional additives may be combined with the treated pulp. The blend chest and machine chest can be of any conventional type known to those skilled in the art. The machine chest ensures a level head, that is, a constant pressure on the treated pulp or stock throughout the downstream portion of the system, particularly at the head box.

From the machine chest, the pulp is passed to a white water silo and then to a fan pump. The retention system polymer of the present invention is preferably introduced into the flow of pulp between the silo and the fan pump. The supply of retention system polymer composition can be, for example, a holding tank having an outlet in communication with a line between the white water silo and the fan pump. As pulp passes from the fan pump to a screen, the fibrous cationic colloidal alumina microparticles are preferably added. Conventional valving and pumps used in connection with introducing conventional additives can be used. The screened pulp passes to a head box where a wet papersheet is made on a wire and drained. In the system of FIG. 1, drained pulp resulting from papermaking in the headbox is recirculated to the white water silo.

Figure 2:
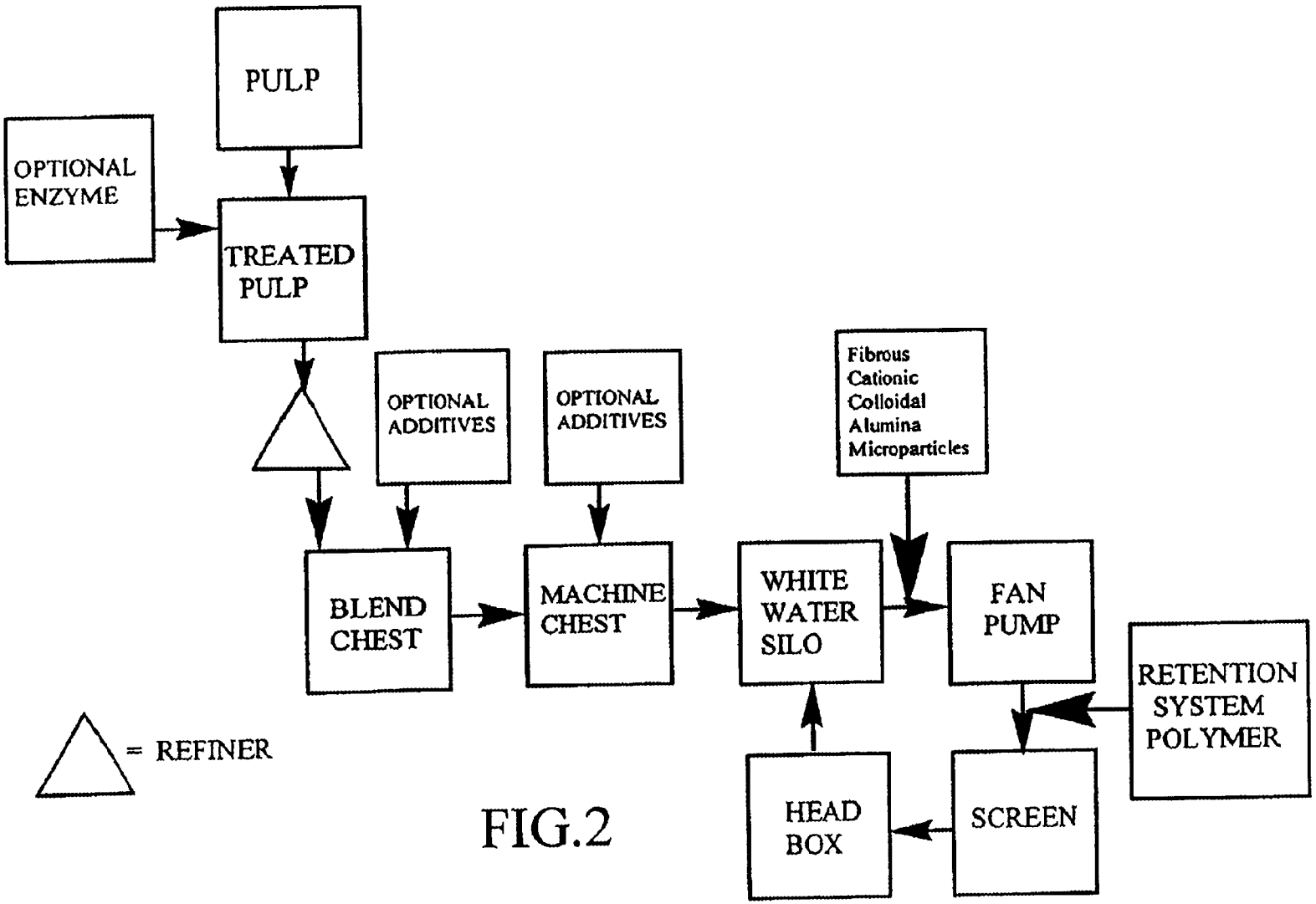
FIG. 2 is a flow chart showing a papermaking process according to another embodiment of the present invention.

In the embodiment shown in FIG. 2, the fibrous cationic colloidal alumina microparticles are added first to the refined treated pulp between the white water silo and the fan pump. The retention system polymer is added after the fan pump and before the screen.

Figure 3:
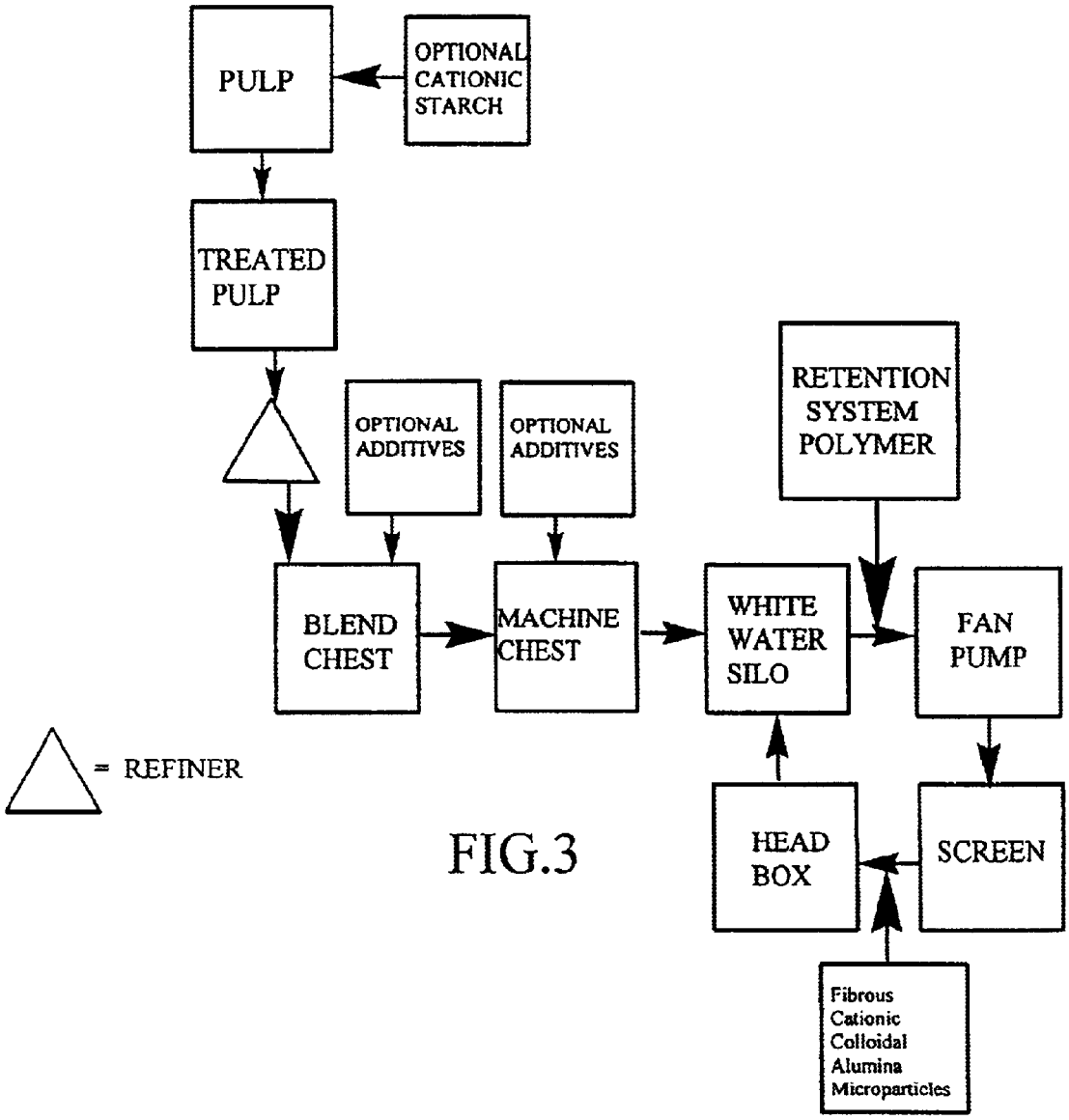
FIG. 3 is a flow chart showing a papermaking process according to another embodiment of the present invention.

Another embodiment of the present invention is shown in FIG. 3. A pulp optionally treated with a cationic starch is refined, passed to a blend chest, passed to a machine chest, and then passed to a white water silo. Between the white water silo and the fan pump the retention system polymer is preferably added to the pulp. The fibrous cationic colloidal alumina microparticles are preferably added after the pulp passes through the screen and just prior to sheet formation in the head box.

The apparatus of the present invention can also include metering devices for providing a suitable concentration of the fibrous cationic colloidal alumina microparticles or other additives to the flow of pulp.

A cleaner, for example, a centrifugal force cleaning device, can be disposed between, for instance, the fan pump and the screen, according to any of the embodiments of FIGS. 1–3 above.

EXAMPLES

In the examples below, various components used in the examples are abbreviated. In the examples, the component identified as "Octasol" is a fibrous cationic colloidal alumina microparticle sol available from Associated Octel. When followed by a numerical value, for example, Octasol 0. 5, the numerical value represents the amount of pounds on a dry basis of the Octasol microparticles per ton of paperstock based on the dried solids weight of the paperstock. "Octasol 3.0", for example, means the paperstock is treated with 3.0 pounds on a dry basis of Octasol per ton of paperstock based on the dried solids weight of the paperstock. The abbreviation "XP9" used in some of the examples represents the same Octasol formulation identified as "Octasol" in other examples. The abbreviation "782" also represents the same Octasol product identified as "XP9" and as "Octasol" in the examples below. The particular Octasol product that was used in the Examples below is identified by Associated Octel as "Octasol 782," with the exception of Octasol products 1317 and 1318 identified in Table 8.

In the examples below, the abbreviation "594" represents BUFLOC® 594, available from Buckman Laboratories International, Inc., which is a high molecular weight cationic polyacrylamide having an average molecular weight of from about 5,000,000 to about 7,000,000 units and a 21% charge density. The abbreviation "5031 " represents BUFLOC® 5031 available from Buckman Laboratories International Inc., which is a low molecular weight cationic polyamine having a 100% charge density and a molecular weight in the range of from about 100,000 to about 300,000.

The abbreviation "CP3" represents POLYFLEX CP3™ and "CP2" represents POLYFLEX CP2™, both available from Buckman Laboratories International, Inc., which are anionic micropolymers used as microparticle retention systems. The abbreviations "5450" and "XP8-558R" represent BUFLOC® 5450 available from Buckman Laboratories International, Inc., which is a cationic synthetic hectorite microparticle system.

The abbreviations "silica", "8671", and "N 8671" represent powdered silica available from Nalco Chemical Co. under the tradename "Nalco 8671". The abbreviations "org 21" and "org" represent ORGANOPOL 21, available from Ciba Geigy, which is a high molecular weight polyacrylamide cationic polymer having a charge density of from about 20% to about 25%. The abbreviations "Bentonite" and "Bent" represent a bentonite colloidal system available from Ciba Geigy as HYDROCOL O. The abbreviation "5376" represent BUFLOC® 5376, available from Buckman Laboratories International, Inc., which is a cationic diallyldimethylammonium chloride having a 95% charge density and a molecular weight of about 500,000. The abbreviation "606" represents "BUFLOC® 606", available from Buckman Laboratories International, Inc., which is an anionic polyacrylamide having a charge density of from about 30% to about 32% and a molecular weight in the range of from about 14,000,000 to about 18,000,000. The abbreviation "5057" represents BUFLOC® 5057, available from Buckman Laboratories International, Inc., which is a non-ionic polyacrylamide having a 0% charge density and a molecular weight of about 15,000,000. The abbreviation "597" represents BUFLOC® 597, available from Buckman Laboratories International, Inc., which is a cationic modified polyethylene imine having a 100% charge density and a molecular weight of from about 2,000,000 to about 3,000,000. The abbreviation "5545" represents BUFLOC® 5545, available from Buckman Laboratories International, Inc., which is an anionic polyacrylamide having a 30% charge density and a molecular weight of from about 17,000,000 to about 20,000,000.

The acronyms PCC, ASA, and PAC also appear in the examples below. The acronym PCC represents powdered precipitated calcium carbonate which is used as a filler material. The acronym ASA represents a sizing agent comprising alkenyl succinic anhydride available as Buckman 151 from Buckman Laboratories International, Inc. The acronym PAC represents polyaluminum chloride in the form of a very low molecular weight cationic charged dipolymer available from Buckman Laboratories International, Inc., as BUFLOC® 5041 or BUFLOC® 569.

Example I

The performance of the OCTASOL fibrous cationic colloidal alumina microparticles, available from Associated Octel, was tested as a retention aid against comparative microparticle technologies used in conventional newsprint furnish.

Procedure

Test were conducted at a paper mill designated paper mill 1. Drainage was performed using a small screen through which 500 ml samples were drained. Mixing was carried out in a food blender. Drainage was performed using a modified Schopper Riegler method.

Equipment used for the modified Shopper Riegler drainage test included the following: a Modified Schopper Riegler (MSR); a 1000 mL graduated cylinder; a stopwatch; a 5-gallon plastic bucket; wires for MSR; a vacuum flask and funnel (for retention); Whatman ashless filter papers (for ash retention); a turbidity meter; a hemocytometer; and a microscope.

Obtaining Samples

A sample to be tested was taken from the headbox. Enough samples were taken for multiple tests. For each test, 1000 ml was required. Because temperature has an impact on drainage, the test was run immediately after the samples were taken. For lab studies with the retention aids, the furnish was kept at the same temperature as the headbox temperature.

Testing the Sample

If the MSR was cold and the sample was hot, the MSR was warmed up by running hot water over the outside and inside of the MSR. If no hot water was available, cold water was used. All tests were conducted in the same way. It was imperative that the MSR wire was devoid of any fibers or fines. The wire was backflushed with water before the test was run. Good fiber, fines, and filler distribution in the sample was ensured by agitating the fiber slurry in the bucket. 1000 ml of the slurry was measured in a graduated cylinder and poured into the MSR while holding the plunger down. The graduated cylinder was placed under the MSR. The plunger was then released and the stop watch started at the same time. The time required for drainage of the sample in incremental units of 100 ml was measured and recorded. The incremental units of 100 ml chosen were purely empirical. For example, very slow stock samples were instead measured at 100, 150, and 200 ml drainage times. Sometimes it took several tests in order to determine the starting volume tests. The different levels of polymers in the various samples were compared, and for this purpose, furnish samples were obtained off of the machine before addition of the retention/drainage aid. Drainage and retention values were compared against blank furnishes to determine improvement. To measure retention performance, the MSR filtrate was filtered through a pre-weighed filter paper, dried in an over at from 105° C. to 120° C., and weighed again. The weight difference was recorded in mg/ml.

Drainage times were compared based on different levels of additives (i.e., starch, polymer, or microparticles) of different furnishes. Drainage times were highly dependent on variables such as temperatures, furnish types, and refining. Drainage times were recorded in seconds for each volume level. The total suspended solids was estimated with a turbidity meter. The filtrate could also have been filtered to determine suspended solids. Solids contents of MSR filtrate could be reported in mg/ml and used to indicate the retention capabilities of different systems, with lower numbers indicating better retention.

For repeated tests, the sample was taken from the same place along the papermaking system. It was ensured that the furnish composition was the same for the repeated test. Repeated tests that did not agree within reason with a corresponding original test were suspect.

The MSR was kept clean and constantly rinsed with water to keep residual fibers from building up on the sides. The screen was periodically cleaned to remove resin build-up, and brushed clean with a mild detergent. The wires were checked to make sure bent or damaged wires were not used. All tests were conducted in the same manner and at the same consistency.

Paper mill 1 employed a paperstock or furnish comprising 30 wt % recycled corrugated cardboard, 60 wt % recycled box cardboard, and 10 wt % ONP. The Hb conductivity of the pulp measured 0.4 meq/L and had a cationic demand. The pH of the paperstock was 7.4. Additives combined with the paperstock included PCC in an amount of 280 pounds per ton of paperstock based on the dried solids weight of the paperstock. The PCC was added before the screens. ASA was added in an amount of 2.1 pounds per ton of paperstock at a point along the paper mill process where the paperstock was in the form of a thin stock. The ASA was added before the fan pump. Before the screens, the Floe 594 was added in an amount of 2.6 pounds per ton of paperstock and after the screens CP3 was added in an amount of 4.5 pounds per ton of paperstock before the headbox.

Furnish used: stock from Newsprint (85% TMP, 15% Broke) pH: 7.6

Polymer addition was constant at 1 pound per ton of paperstock, based on the dried solids weight of both the polymer and the paperstock.

All microparticle dosages were calculated on dry basis.

The results of the test are shown in Tables 1–4 below. In each of Tables 1–4, the column headings "100", "150 ", and "100" represent the number of milliliters of filtrate collected that drained through the wire. The corresponding numbers underneath the column headings represent the number of seconds needed for the respective number of milliliters (ml) of filtrate to drain through the wire and be collected. For example, in the first entry of Table 1, the paperstock identified as "Blank", (having no microparticle retention system) required 14 seconds for 100 ml of filtrate to be drained through the forming wire and collected, required 32 seconds for 150 ml of filtrate to be collected, and required 62 seconds or 200 ml of filtrate to be collected. In Tables 1–4 the turbidity, measured in units of NTU, is listed in the last column of each table such that, for example, the turbidity of the "Blank" sample listed in Table 1 was 232 NTU. For each of the various examples tested and reported in Tables 1–4, the microparticle additive, if used, was added at the same respective point in the respective papermaking process and each of the retention polymers was added at the same respective point in the respective papermaking process.

In conclusion, OCTASOL worked as well as the bentonite system. The performance was better than a dual component system (5031/5376 with 594). The comparisons can be seen in Tables 1–4 below.

Figure 4:
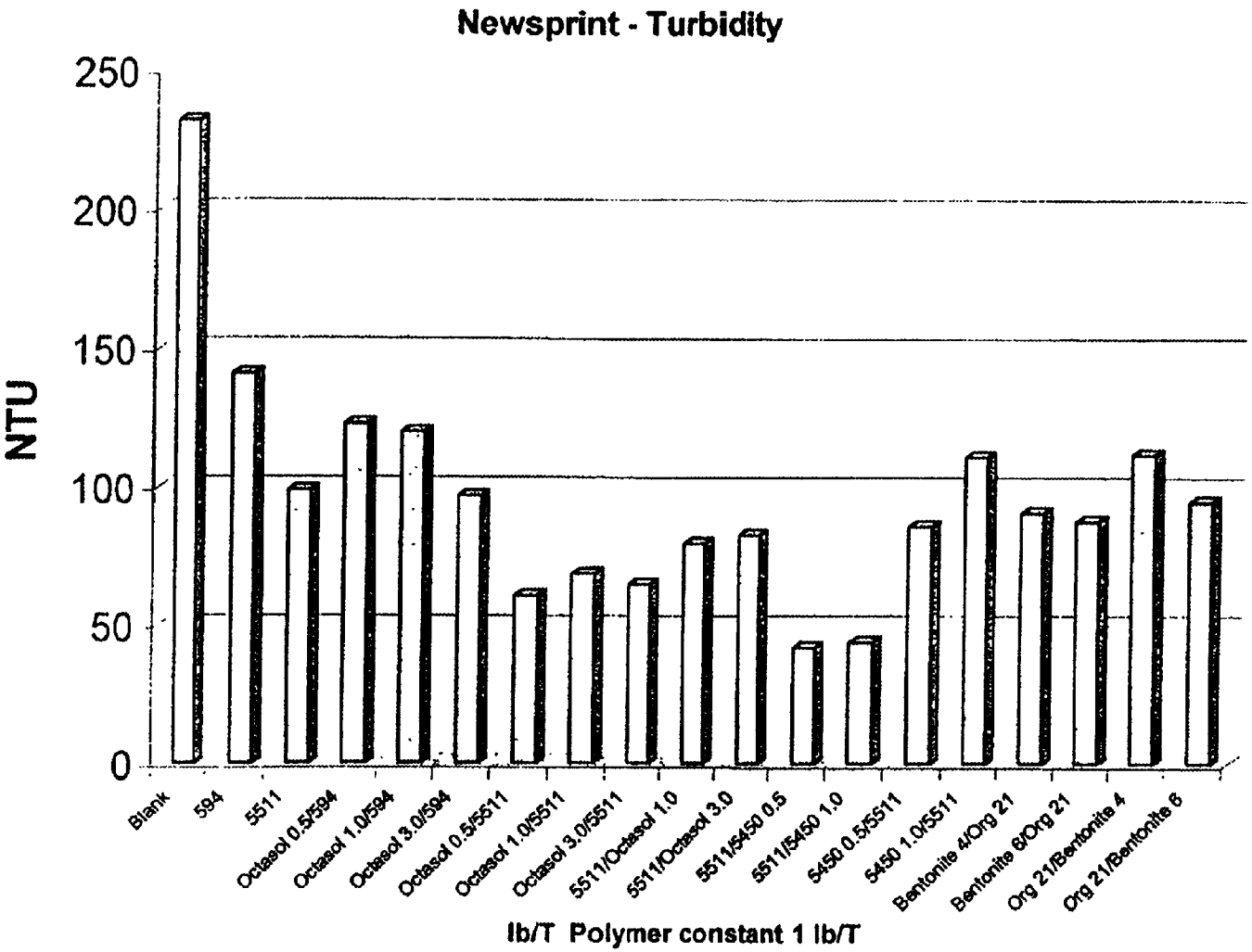
FIG. 4 is a bar graph comparing the turbidity of various exemplary and comparative paperstock formulations.
Figure 5:
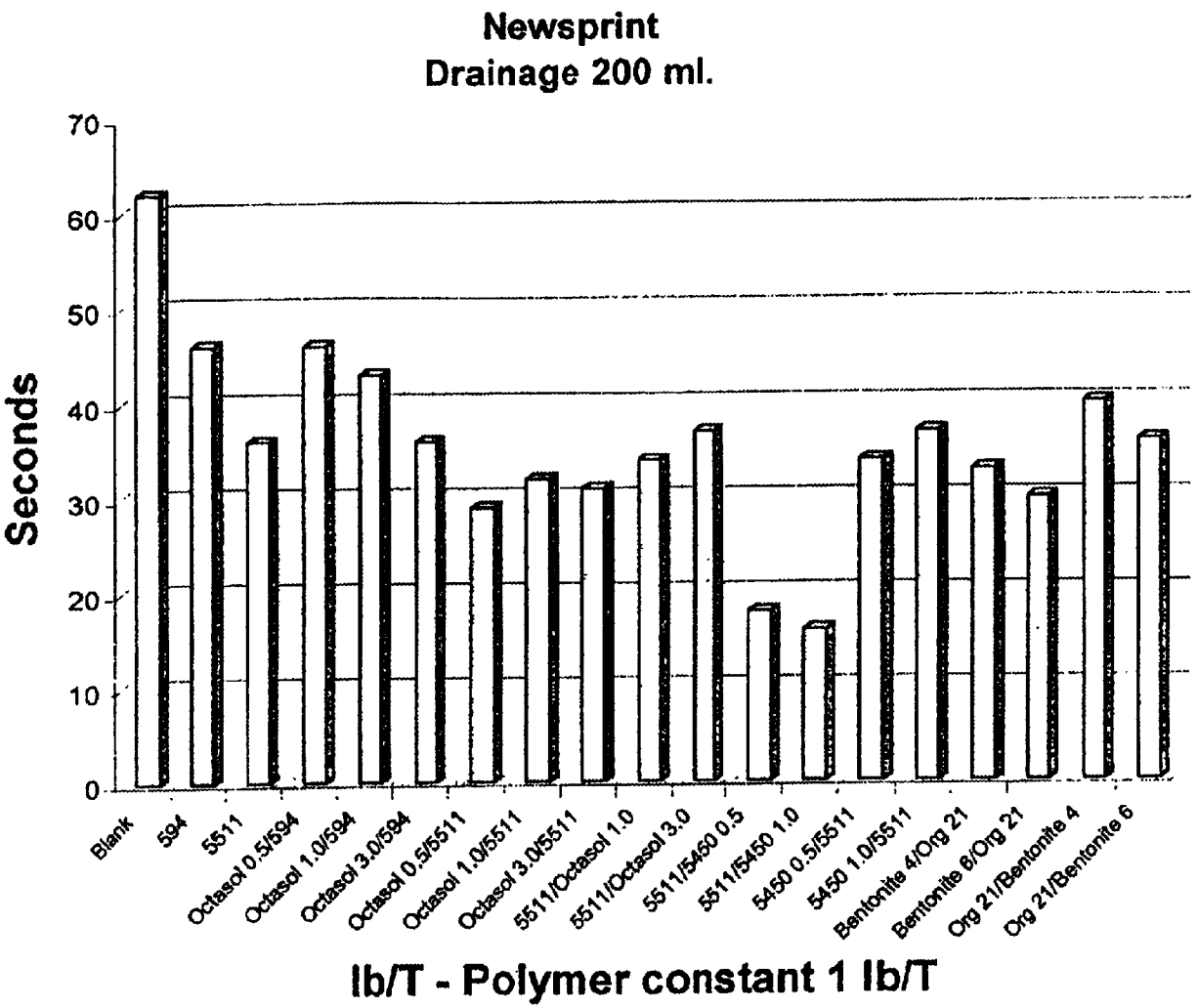
FIG. 5 is a bar graph showing the time to achieve drainage of 200 ml of filtrate from paperwebs made of various exemplary and comparative paperstock formulations.
Figure 6:
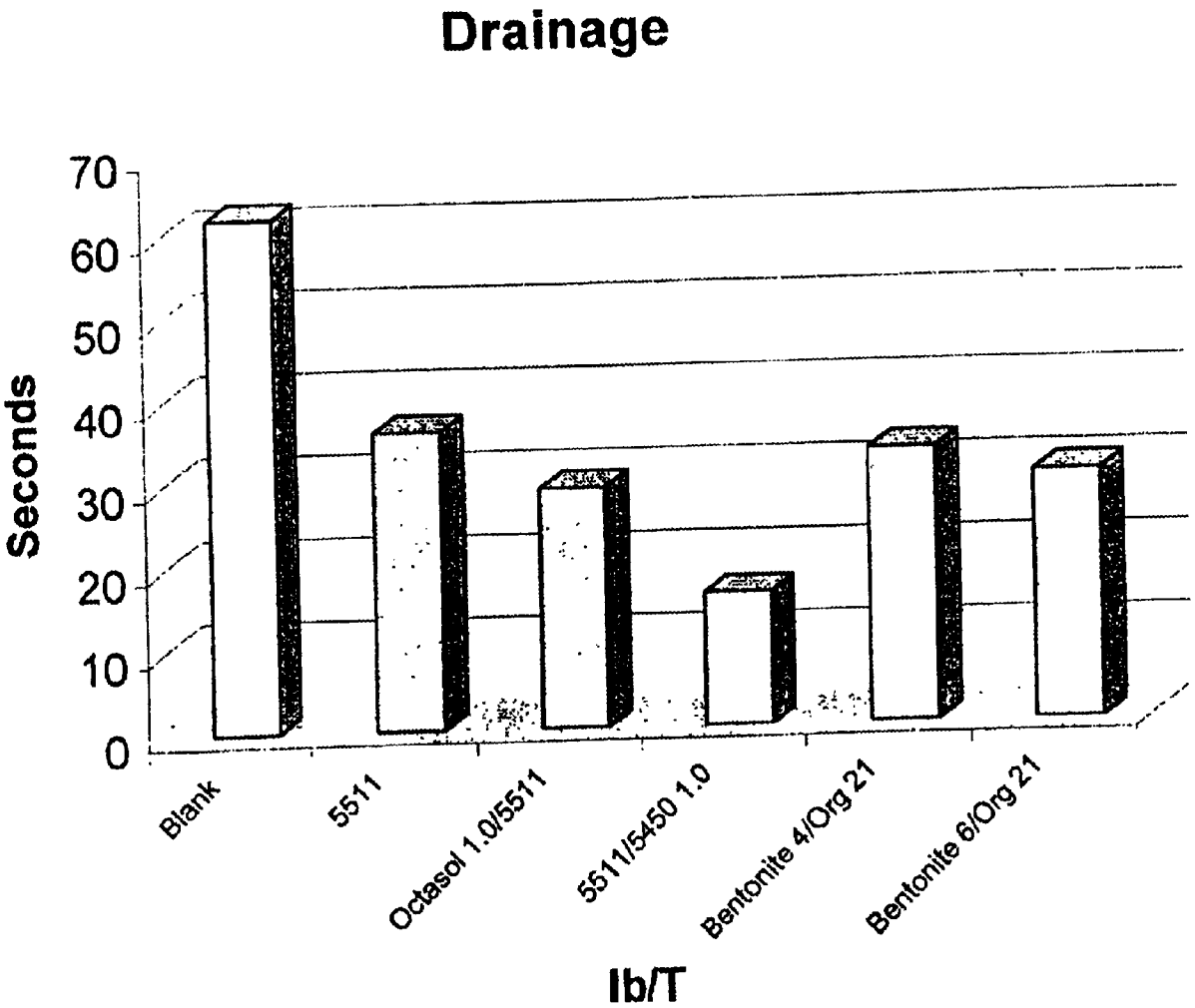
FIG. 6 is a bar graph showing the drainage in seconds of various exemplary and comparative paperstock formulations.
Figure 7:
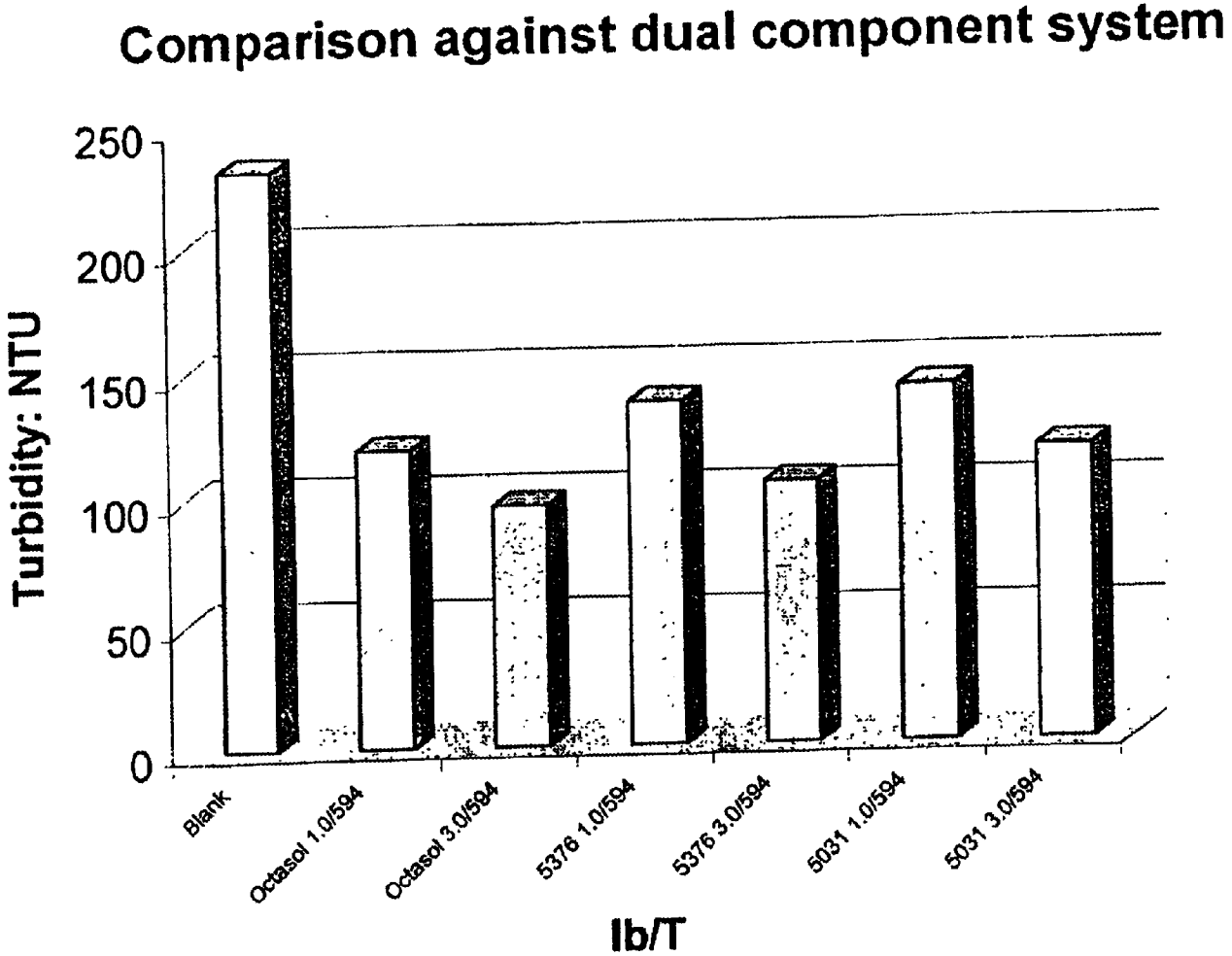
FIG. 7 is a bar graph showing the turbidity of various exemplary and comparative paperstock formulations.
Figure 8:
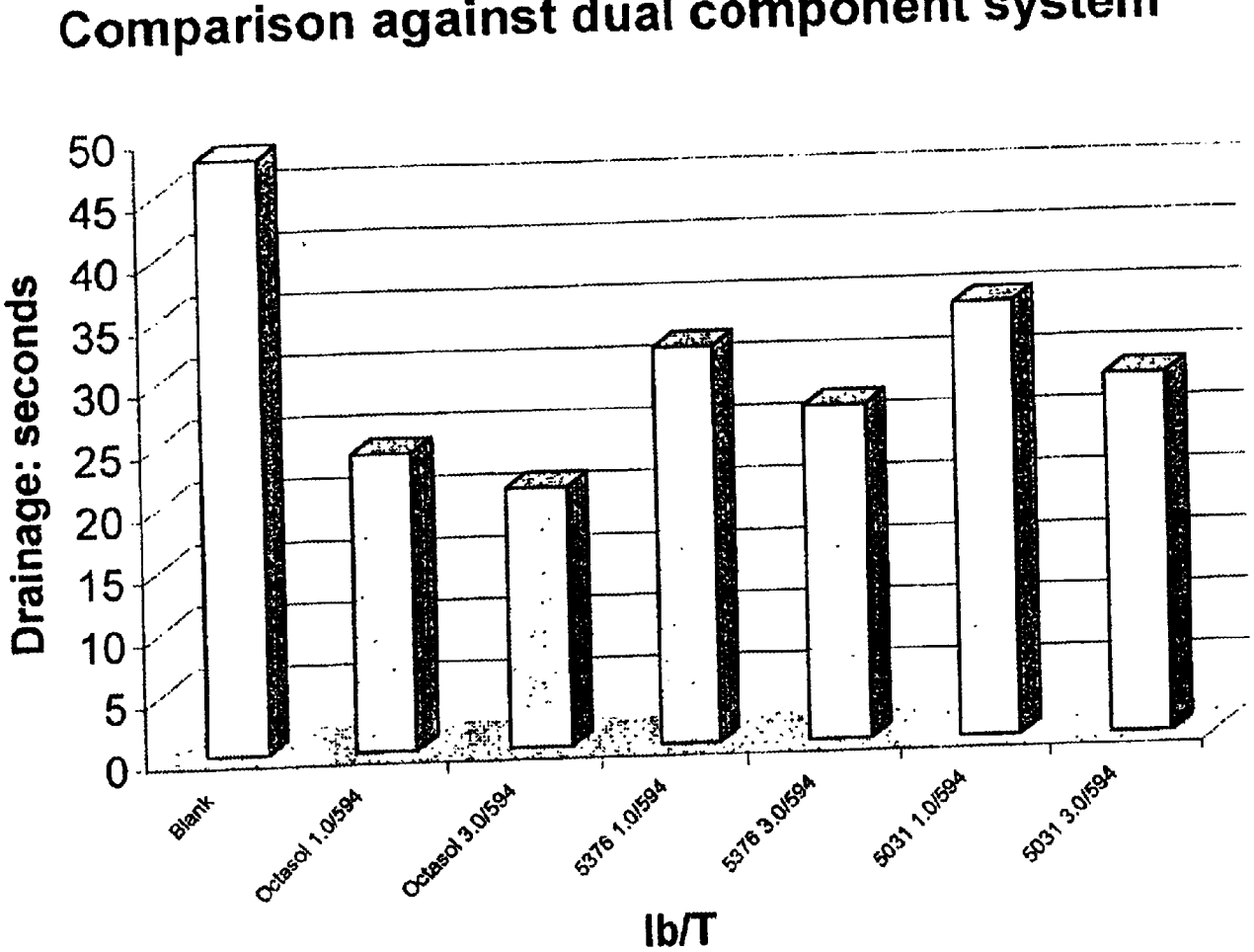
FIG. 8 is a bar graph showing the drainage in seconds of various exemplary and comparative paperstock formulations.
Figure 9:
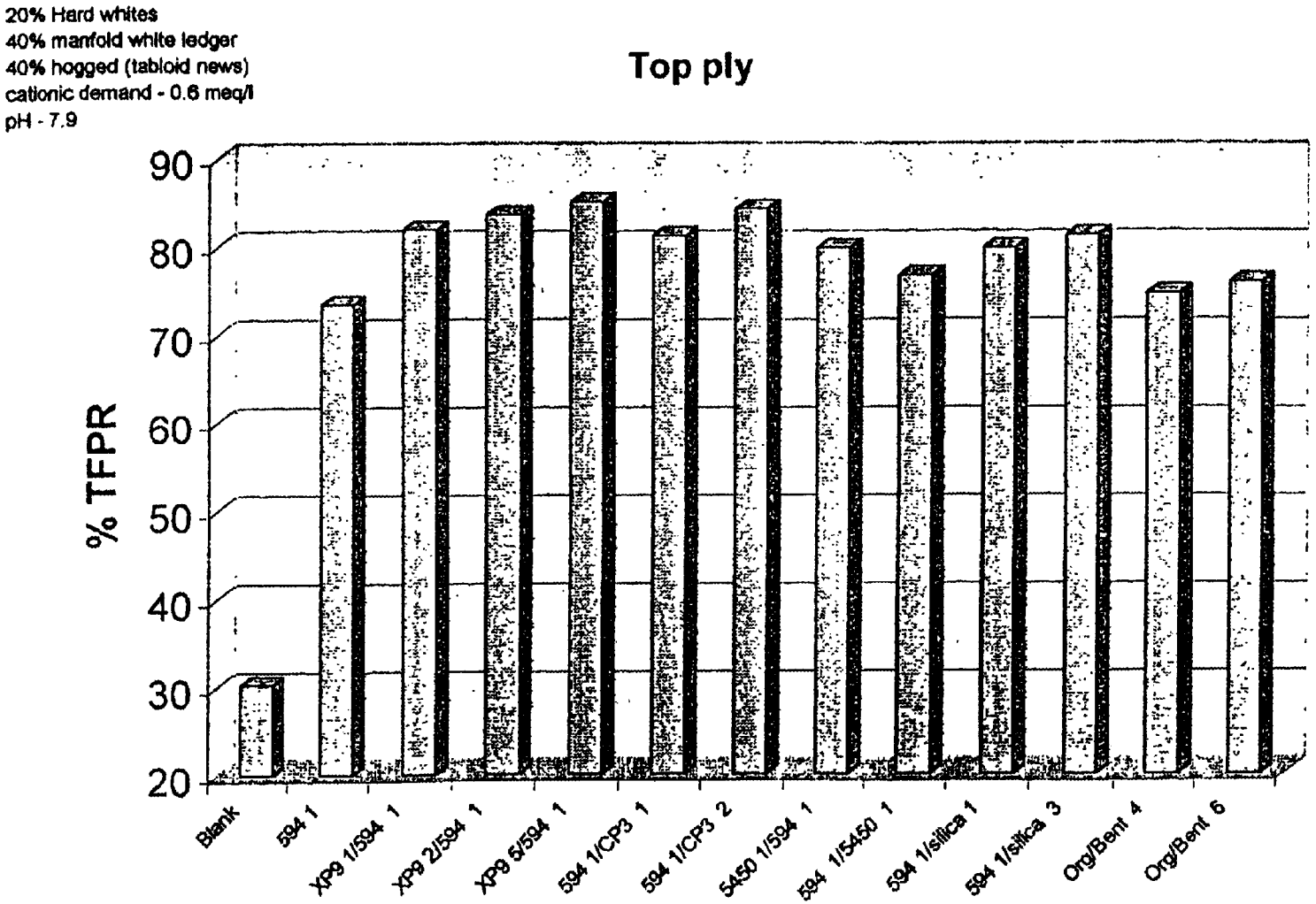
FIG. 9 is a bar graph showing the % TFPR of various exemplary and comparative paperstock formulations.
Figure 10:
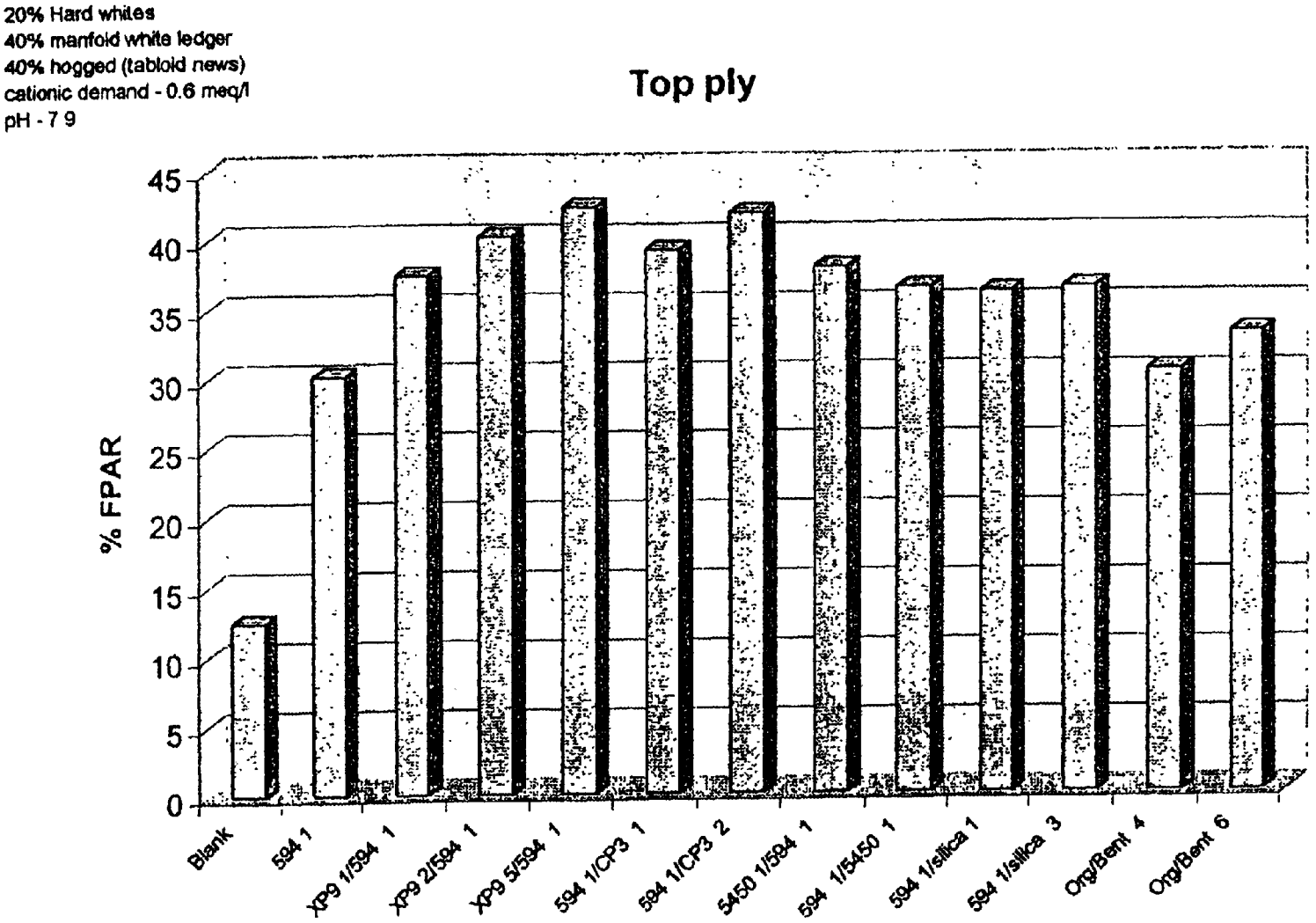
FIG. 10 is a bar graph showing the % FPAR of various exemplary and comparative paperstock formulations.
Figure 11:
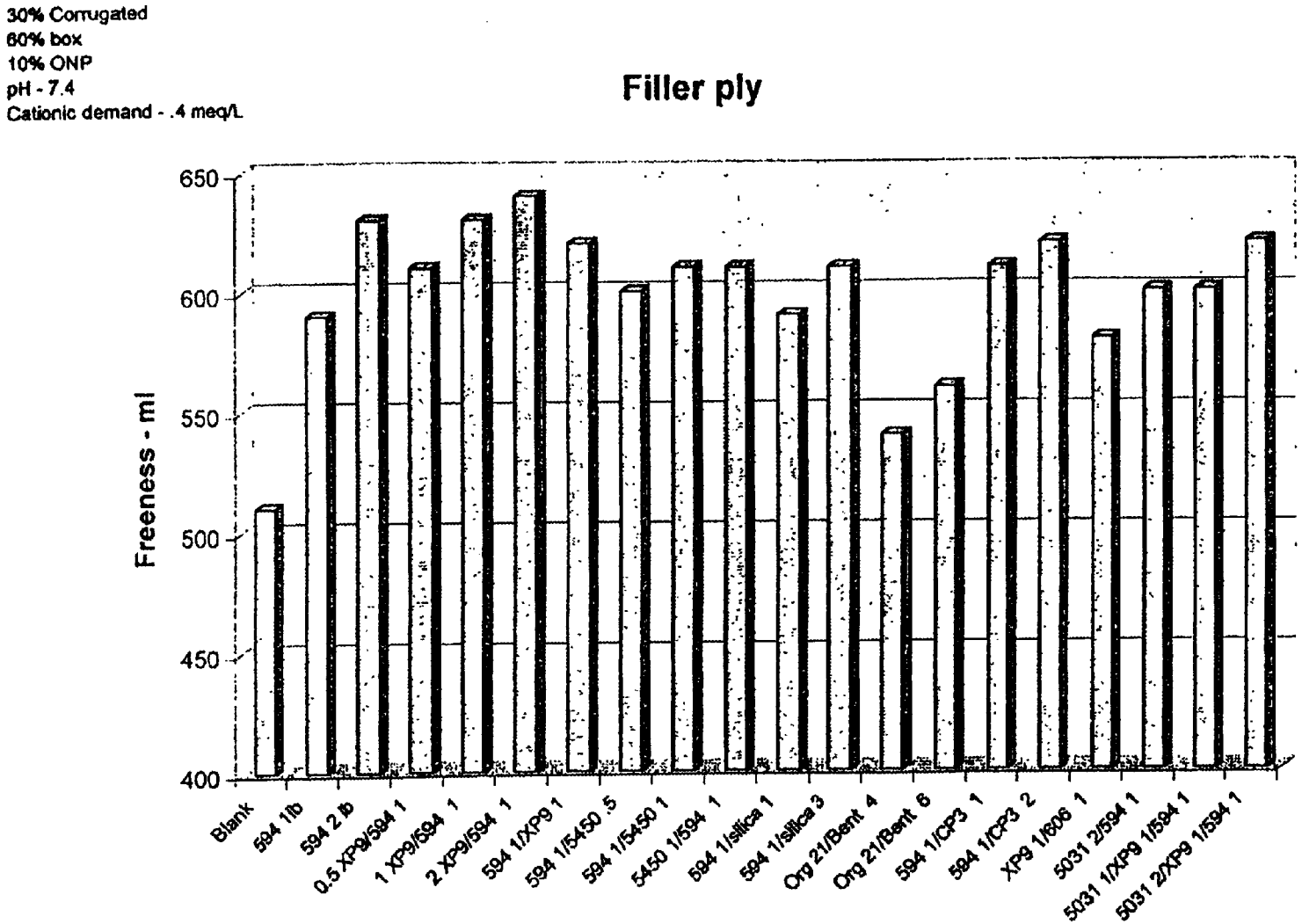
FIG. 11 is a bar graph showing the freeness in ml of various exemplary and comparative paperstock formulations.
Figure 12:
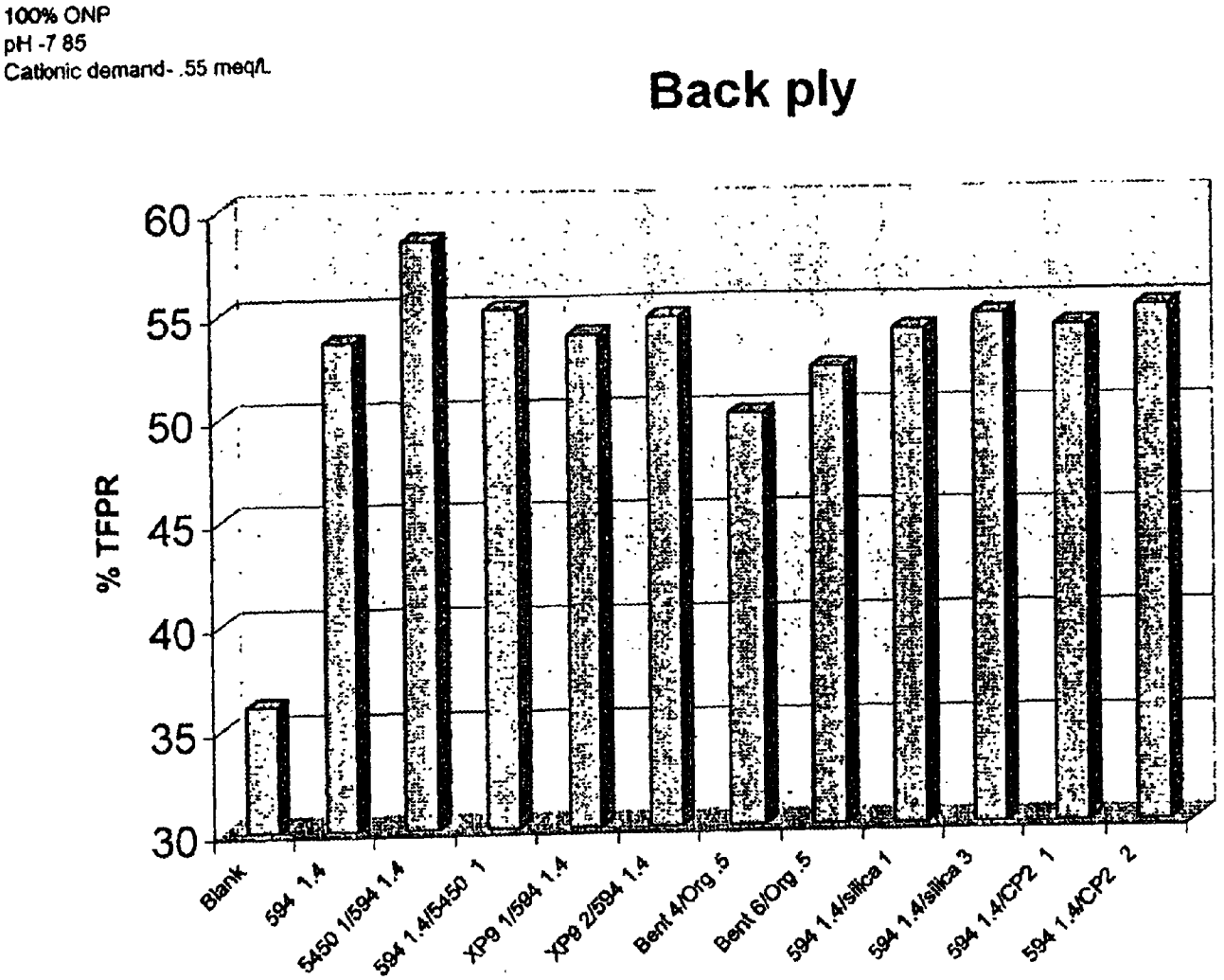
FIG. 12 is a bar graph showing the % TFPR of various exemplary and comparative paperstock formulations.

The results reported in Table 1 are shown graphically in FIGS. 4 and 5. The results reported in Table 2 are shown graphically in FIG. 6. The results reported in Table 3 are shown graphically in FIGS. 7 and 8.

TABLE 1

| | 100 | 150 | 200 | Turbidity |
|---|---|---|---|---|
| Blank | 14 | 32 | 62 | 232 |
| 594 | 11 | 26 | 46 | 141 |
| 5511 | 11 | 20 | 36 | 99 |
| Octasol 0.5/594 | 12 | 26 | 46 | 123 |
| Octasol 1.0/594 | 11 | 24 | 43 | 120 |
| Octasol 3.0/594 | 10 | 21 | 36 | 97 |
| Octasol 0.5/5511 | 8 | 16 | 29 | 61 |
| Octasol 1.0/5511 | 8 | 17 | 32 | 69 |
| Octasol 3.0/5511 | 8 | 18 | 31 | 65 |
| 5511/Octasol 1.0 | 9 | 19 | 34 | 80 |
| 5511/Octasol 3.0 | 9 | 23 | 37 | 83 |
| 5511/5450 0.5 | 5 | 11 | 18 | 42 |
| 5511/5450 1.0 | 5 | 10 | 16 | 44 |
| 5450 0.5/5511 | 9 | 18 | 34 | 86 |
| 5450 1.0/5511 | 10 | 22 | 37 | 111 |
| Bentonite 4/Org 21 | 9 | 19 | 33 | 91 |
| Bentonite 6/Org 21 | 8 | 16 | 30 | 88 |
| Org 21/Bentonite 4 | 11 | 22 | 40 | 112 |
| Org 21/Bentonite 6 | 9 | 20 | 36 | 95 |

TABLE 2

| | 100 | 150 | 200 | Turbidity |
|---|---|---|---|---|
| Blank | 14 | 32 | 62 | 232 |
| 5511 | 11 | 20 | 36 | 99 |
| Octasol 1.0/5511 | 8 | 17 | 29 | 69 |
| 5511/5450 1.0 | 5 | 10 | 16 | 44 |
| Bentonite 4/Org 21 | 9 | 19 | 33 | 91 |
| Bentonite 6/Org 21 | 8 | 16 | 30 | 88 |

TABLE 3

| | 100 | 150 | 200 | Turbidity |
|---|---|---|---|---|
| Blank | 21 | 48 | 70 | 232 |
| Octasol 1.0/594 | 11 | 24 | 43 | 120 |
| Octasol 3.0/594 | 10 | 21 | 36 | 97 |

TABLE 3-continued

| | 100 | 150 | 200 | Turbidity |
|---|---|---|---|---|
| 5376 1.0/594 | 12 | 32 | 49 | 138 |
| 5376 3.0/594 | 13 | 27 | 43 | 105 |
| 5031 1.0/594 | 11 | 35 | 49 | 143 |
| 5031 3.0/594 | 12 | 29 | 46 | 118 |

TABLE 4

| | 100 | 150 | 200 | Turbidity |
|---|---|---|---|---|
| Blank | 21 | 43 | 70 | 232 |
| Octasol 1.0/594 | 12 | 26 | 47 | 126 |
| Octasol 3.0/594 | 11 | 25 | 45 | 109 |
| 5376 1.0/594 | 12 | 27 | 49 | 138 |
| 5376 3.0/594 | 13 | 25 | 43 | 105 |
| 5031 1.0/594 | 11 | 28 | 49 | 143 |
| 5031 3.0/594 | 12 | 29 | 46 | 118 |
| Octasol 1.0/5511 | | | | |
| Octasol 3.0/5511 | 12 | 25 | 47 | 116 |
| 5376 1.0/5511 | | | | |
| 5376 3.0/5511 | 11 | 24 | 44 | 127 |
| 5031 1.0/5511 | | | | |
| 5031 3.0/5511 | | | | |
| 5450 1.0/5511 | 8 | 18 | 30 | 88 |

Example II

The performance of the OCTASOL microparticles was tested against comparative microparticle technologies.

Procedure

Testing was done at different commercial paper mills.

Information about the respective paperstocks used is shown on the graphs attached.

The components of the furnish or paperstock are listed on the graphs shown as FIGS. 9–12 attached hereto. The % TFPR and % FPAR results are shown in Table 5 for the paperstock described in Table 5. The results from Table 5 are shown graphically in FIGS. 9 and 10. The freeness test results for various examples are shown in Table 6 and graphically depicted in FIG. 11. Table 7 shows the % TFPR for yet another paperstock. The results reported in Table 7 are shown graphically in FIG. 12.

In conclusion, the medium charged sample OCTASOL (XP9) performed well. Old and new samples of the XP9 performed about the same, indicating good stability of the microparticle sol. The results show that OCTASOL performs well on alkaline fine paper.

TABLE 5

| Top<br>20% hard whites<br>40% manfold white ledger<br>40% hogged (tabloid news)<br>pH - 7.9<br>cationic demand - .6 meq/L | % TFPR | % FPAR |
|---|---|---|
| Blank | 30.3 | 12.5 |
| 594 1 | 73.4 | 30.2 |
| XP9 1/594 1 | 81.9 | 37.4 |
| XP9 2/594 1 | 83.6 | 40.2 |
| XP9 5/594 1 | 85.1 | 42.3 |
| 594 1/CP3 1 | 81.2 | 39.2 |
| 594 1/CP3 2 | 84.3 | 41.8 |
| 5450 1/594 1 | 79.8 | 37.9 |
| 594 1/5450 1 | 76.7 | 36.4 |
| 594 1/silica 1 | 79.8 | 36.1 |

TABLE 5-continued

| Top<br>20% hard whites<br>40% manfold white ledger<br>40% hogged (tabloid news)<br>pH - 7.9<br>cationic demand - .6 meq/L | % TFPR | % FPAR |
|---|---|---|
| 594 1/silica 3 | 81.2 | 36.4 |
| Org/Bent 4 | 74.6 | 30.4 |
| Org/Bent 6 | 75.9 | 33.1 |

TABLE 6

| Freeness | ml |
|---|---|
| Blank | 510 |
| 594 1 lb | 590 |
| 594 2 lb | 630 |
| 0.5 XP9/594 1 | 610 |
| 1 XP9/594 1 | 630 |
| 2 XP9/594 1 | 640 |
| 594 1/XP9 1 | 620 |
| 594 1/5450 .5 | 600 |
| 594 1/5450 1 | 610 |
| 5450 1/594 1 | 610 |
| 594 1/silica 1 | 590 |
| 594 1/silica 3 | 610 |
| Org 21/Bent 4 | 540 |
| Org 21/Bent 6 | 560 |
| 594 1/CP3 1 | 610 |
| 594 1/CP3 2 | 620 |
| XP9 1/606 1 | 580 |
| 5031 2/594 1 | 600 |
| 5031 1/XP9 1/594 1 | 600 |
| 5031 2/XP9 1/594 1 | 620 |

TABLE 7

| Back<br>pH 7.85<br>catinoic demand<br>0.55 meq/l | 100%<br>ONP<br><br>% TFPR |
|---|---|
| Blank | 36.1 |
| 594 1.4 | 53.6 |
| 5450 1/594 1.4 | 58.4 |
| 594 1.4/5450 1 | 55.1 |
| XP9 1/594 1.4 | 53.8 |
| XP9 2/594 1.4 | 54.6 |
| Bent 4/Org .5 | 49.9 |
| Bent 6/Org .5 | 52.1 |
| 594 1.4/silica 1 | 53.9 |
| 594 1.4/silica 3 | 54.6 |
| 594 1.4/CP2 1 | 54 |
| 594 1.4/CP2 2 | 54.9 |

Figure 13:
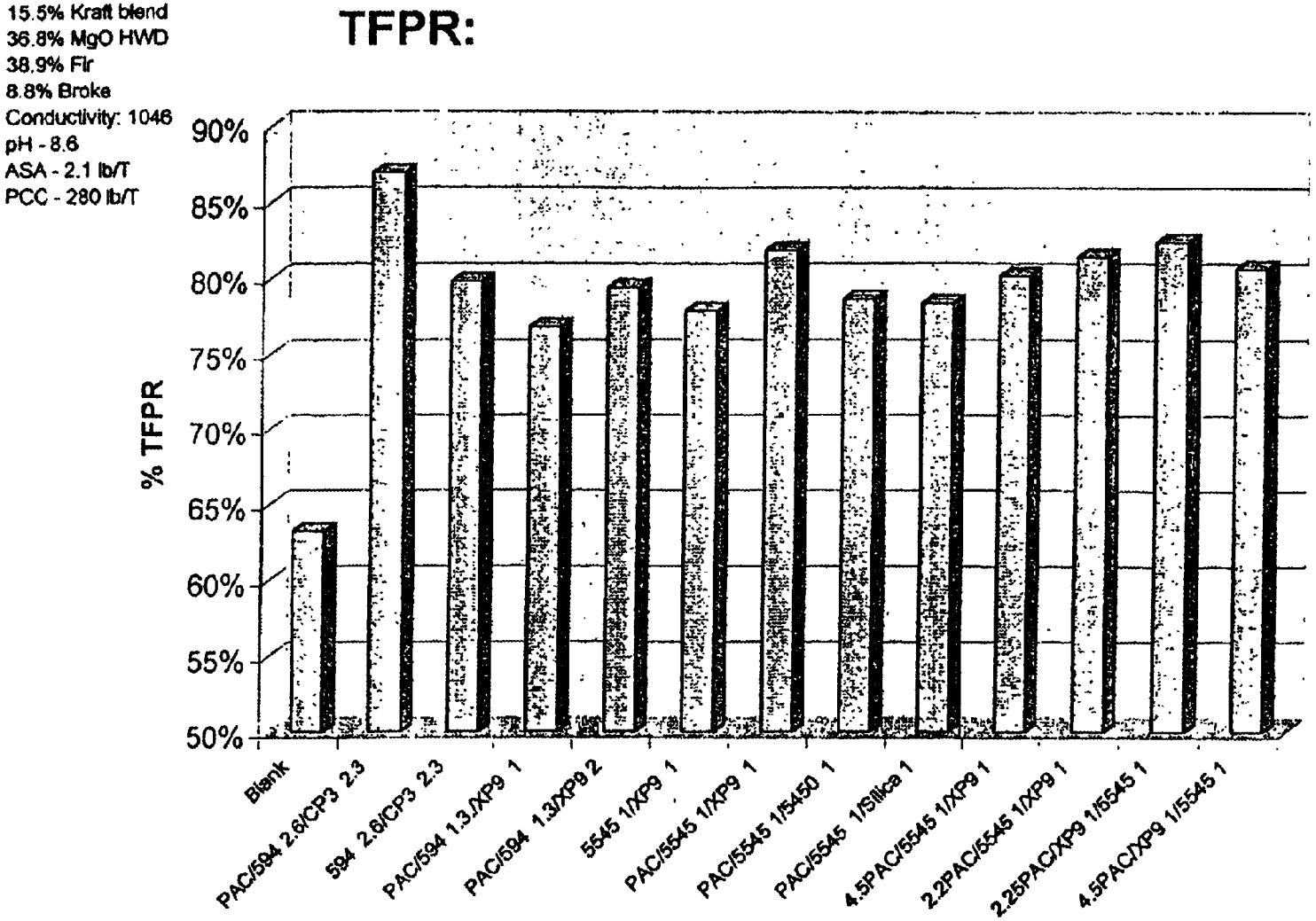
FIG. 13 is a bar graph showing the % TFPR of various exemplary and comparative paperstock formulations.
Figure 14:
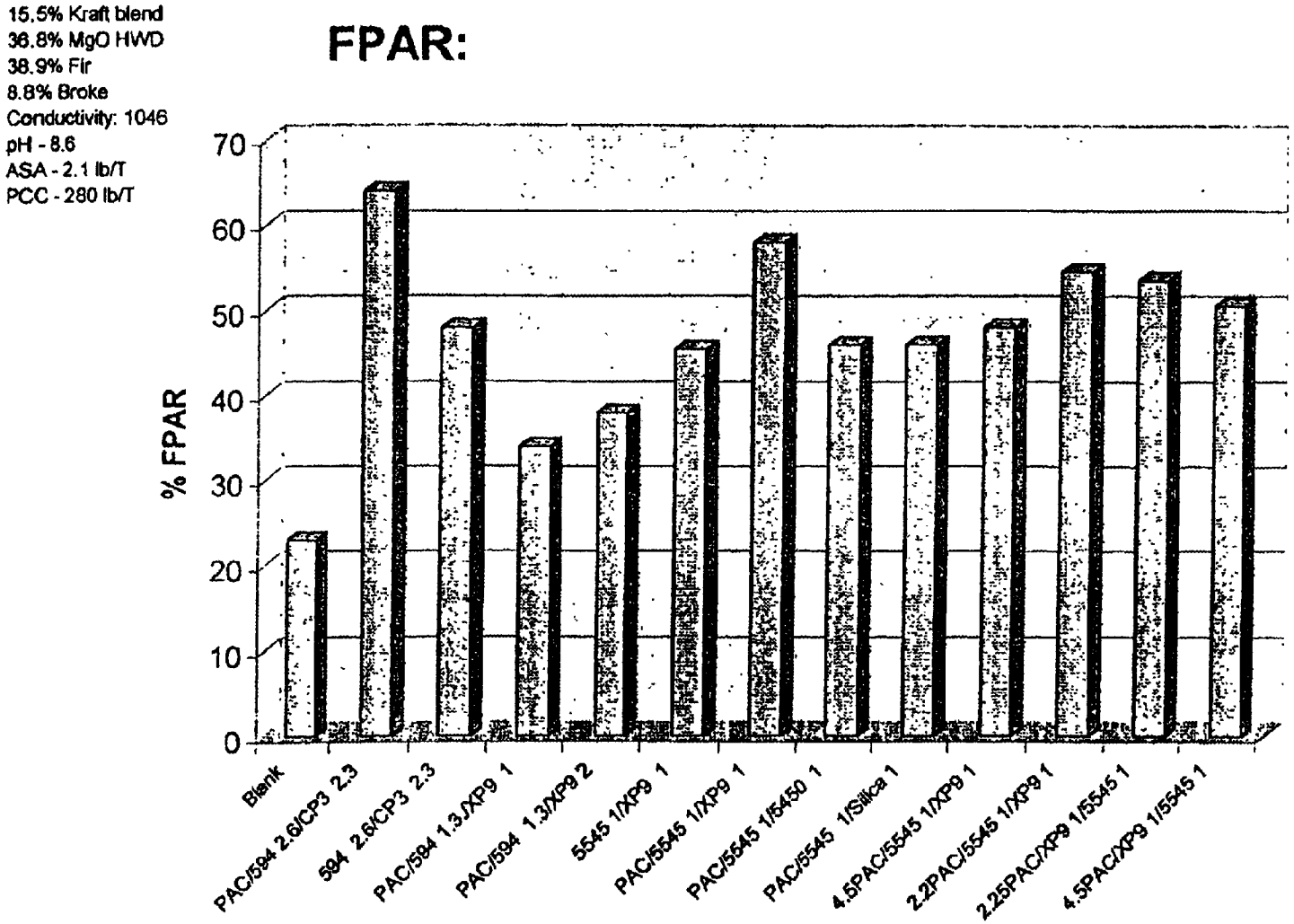
FIG. 14 is a bar graph showing the % FPAR of various exemplary and comparative paperstock formulations.
Figure 15:
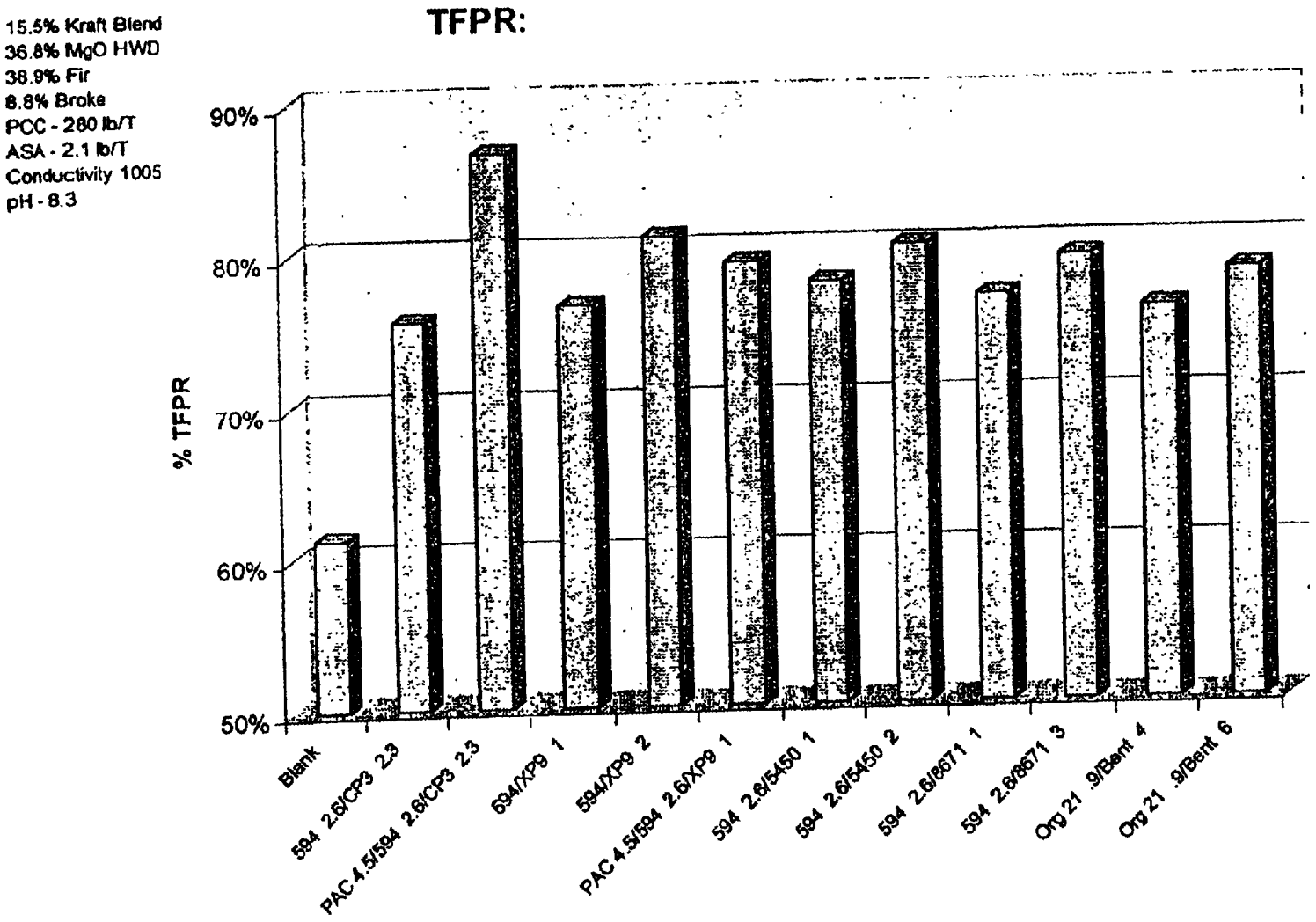
FIG. 15 is a bar graph showing the % TFPR of various exemplary and comparative paperstock formulations.
Figure 16:
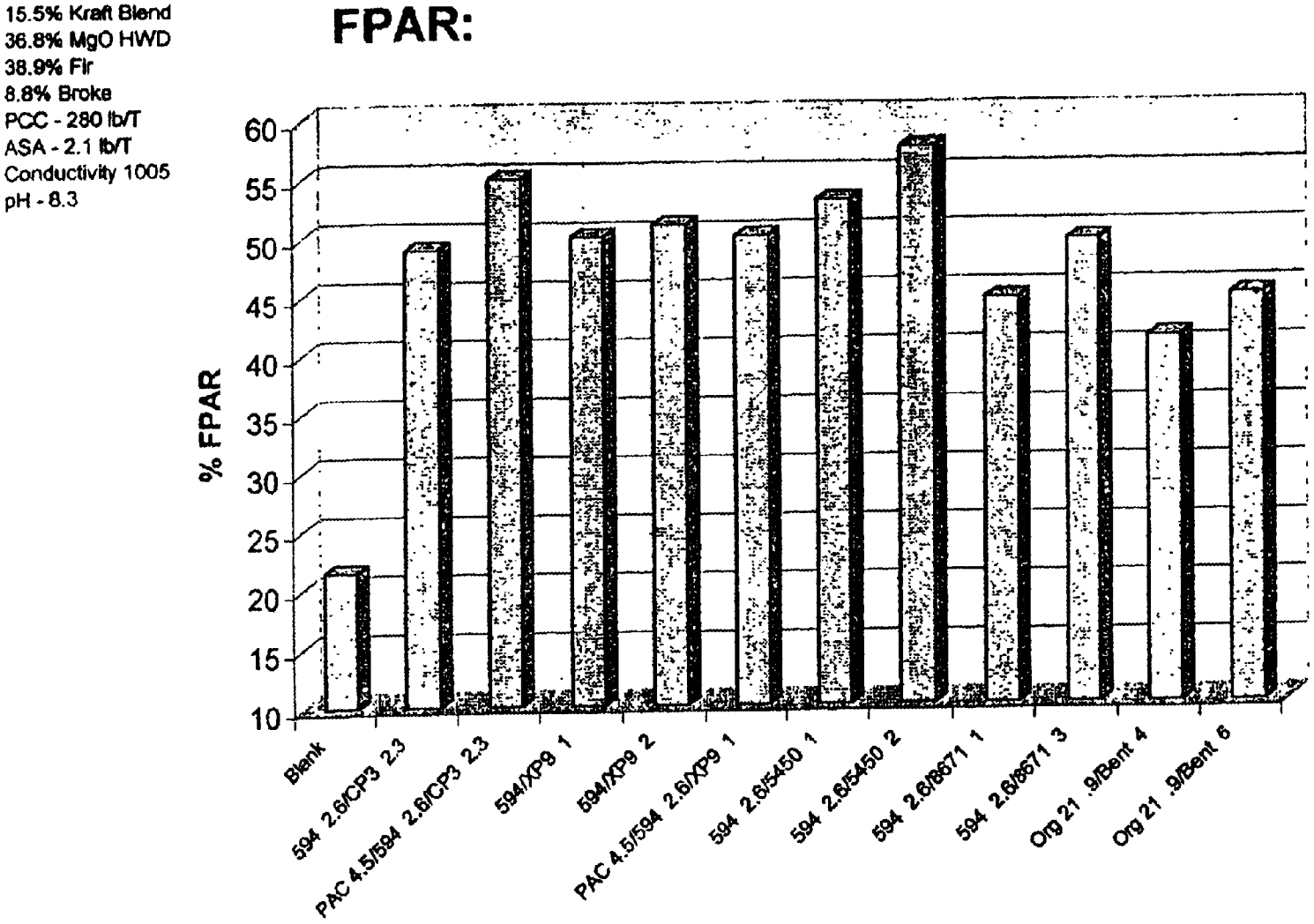
FIG. 16 is a bar graph showing the % FPAR of various exemplary and comparative paperstock formulations.

Table 8 shows % TFPR results for various examples tested. In Table 8, the examples which have been designated "PAC first" are examples wherein the PAC was added before the retention system polymer and microparticles. The results from Table 8 are shown graphically in FIG. 13. The results reported in Table 8 and shown in FIG. 13 were from examples run at paper mill 2. FIGS. 14–16 show various other test results achieved from the examples run at paper mill 2.

On paper mill 2, for each of the paperstocks described on the graphs shown in FIGS. 13–16, PCC was added to the paperstock in an amount of 280 pounds per ton before the screens. ASA was added to the paperstock in an amount of 2.1 pounds per ton at a point during the papermaking process where the paperstock was in the form of a thin stock.

BUFLOC® 594 was added in an amount of 2.6 pounds per ton of paperstock before the screens. CP3 was added in an amount of 2.3 pounds per ton after the screens. PAC was added in an amount of 4.5 pounds per ton before the headbox. The addition of these additives were all based on a dry basis and on the dried solids weight of the paperstock.

TABLE 8

| | | | | | % TFPR | |
|---|---|---|---|---|---|---|
| 2 | 594 | 2.6 | CP3 | 2.30 | 86.9% | 4.5 lb/t PAC first |
| 5 | 5545 | 1 | 782 | 1.00 | 81.8% | 4.5 lb/t PAC first |
| 9 | 5545 | 0.5 | 782 | 1.00 | 80.6% | 4.5 lb/t PAC first |
| 12 | 5545 | 1.0 | 1318 | 1.00 | 80.6% | 4.5 lb/t PAC first |
| 14 | 5545 | 1.0 | 8671 | 1.00 | 80.3% | 4.5 lb/t PAC first |
| 10 | 5545 | 1.0 | 782old | 1.00 | 80.0% | 4.5 lb/t PAC first |
| 3 | 594 | 2.6 | CP3 | 2.30 | 79.8% | |
| 6 | 5545 | 0.5 | 782 | 1.00 | 79.4% | |
| 8 | 594 | 1.3 | 782 | 2.00 | 79.4% | 4.5 lb/t PAC first |
| 11 | 5545 | 1.0 | 1317 | 1.00 | 79.2% | 4.5 lb/t PAC first |
| 13 | 5545 | 1.0 | 5450 | 1.00 | 78.6% | 4.5 lb/t PAC first |
| 4 | 5545 | 1 | 782 | 1.00 | 77.8% | |
| 7 | 594 | 1.3 | 782 | 1.00 | 76.8% | 4.5 lb/t PAC first |
| 1 | None | | | | 73.3% | |
| 15 | 5545 | 1.0 | 782 | 1 | 81.4% | 2.25 lb/t PAC first |
| 16 | 5545 | 1.0 | 782 | 3 | 81.3% | 4.5 lb/t PAC first |
| 17 | 5545 | 1.0 | 782 | 1 | 80.1% | 4.5 lb/t PAC first |
| 18 | 5545 | 1.0 | 782 | 3 | 79.4% | 2.25 lb/t PAC first |
| 19 | 5545 | 1.0 | 782 | 2 | 79.4% | 2.25 lb/t PAC first |
| 20 | 5545 | 1.0 | 782 | 2 | 79.0% | 4.5 lb/t PAC first |
| 21 | 5545 | 0.5 | 782 | 2 | 77.8% | 2.25 lb/t PAC first |
| 22 | 5545 | 0.5 | 782 | 1 | 76.4% | 4.5 lb/t PAC first |
| 23 | 5545 | 0.5 | 782 | 1 | 75.6% | 2.25 lb/t PAC first |
| 24 | 5545 | 0.5 | 782 | 2 | 75.5% | 4.5 lb/t PAC first |
| 25 | 5545 | 0.5 | 782 | 3 | 74.7% | 2.25 lb/t PAC first |
| 26 | 5545 | 0.5 | 782 | 3 | 74.6% | 4.5 lb/t PAC first |

Figure 17:
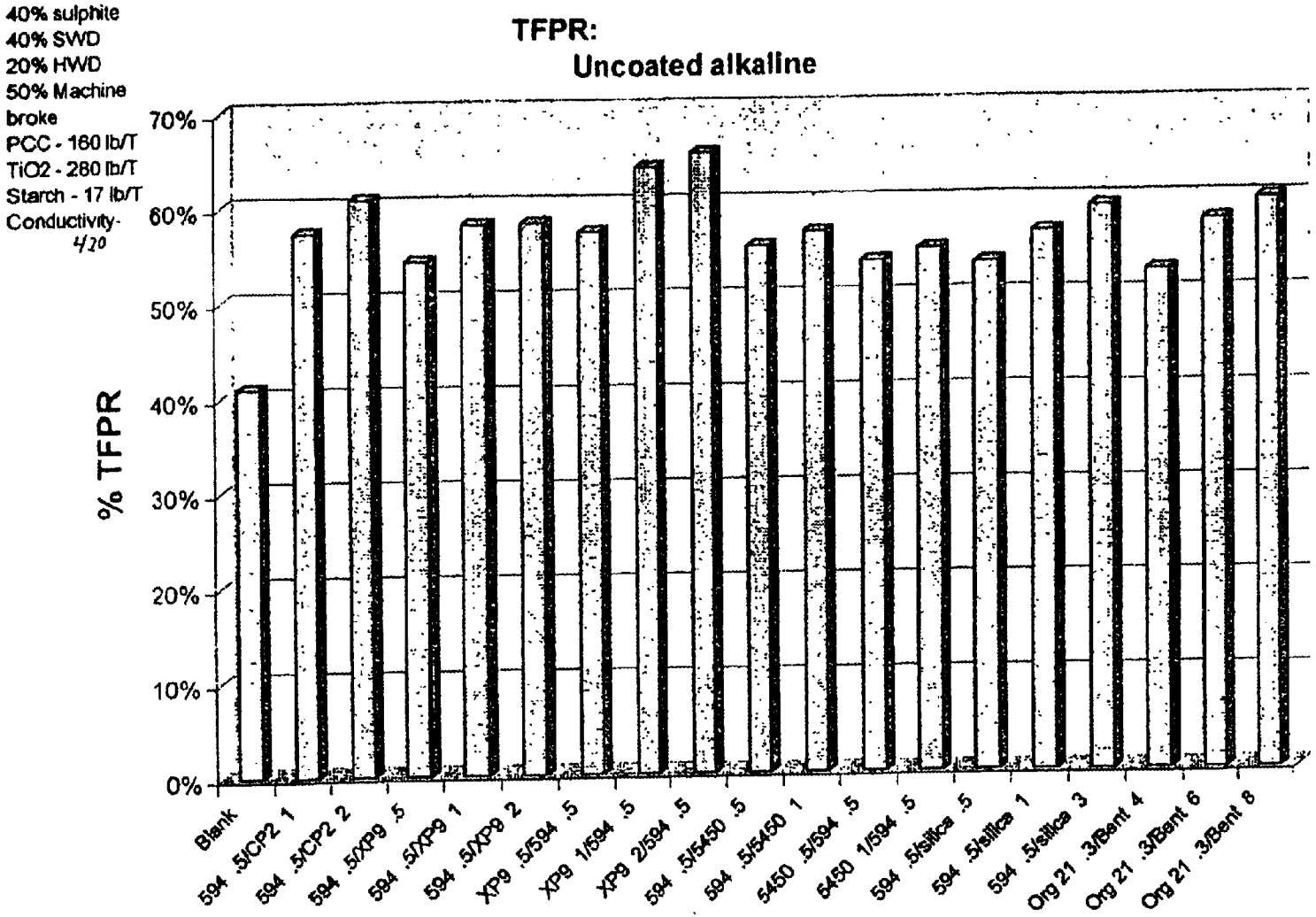
FIG. 17 is a bar graph showing the % TFPR of various exemplary and comparative paperstock formulations.
Figure 18:
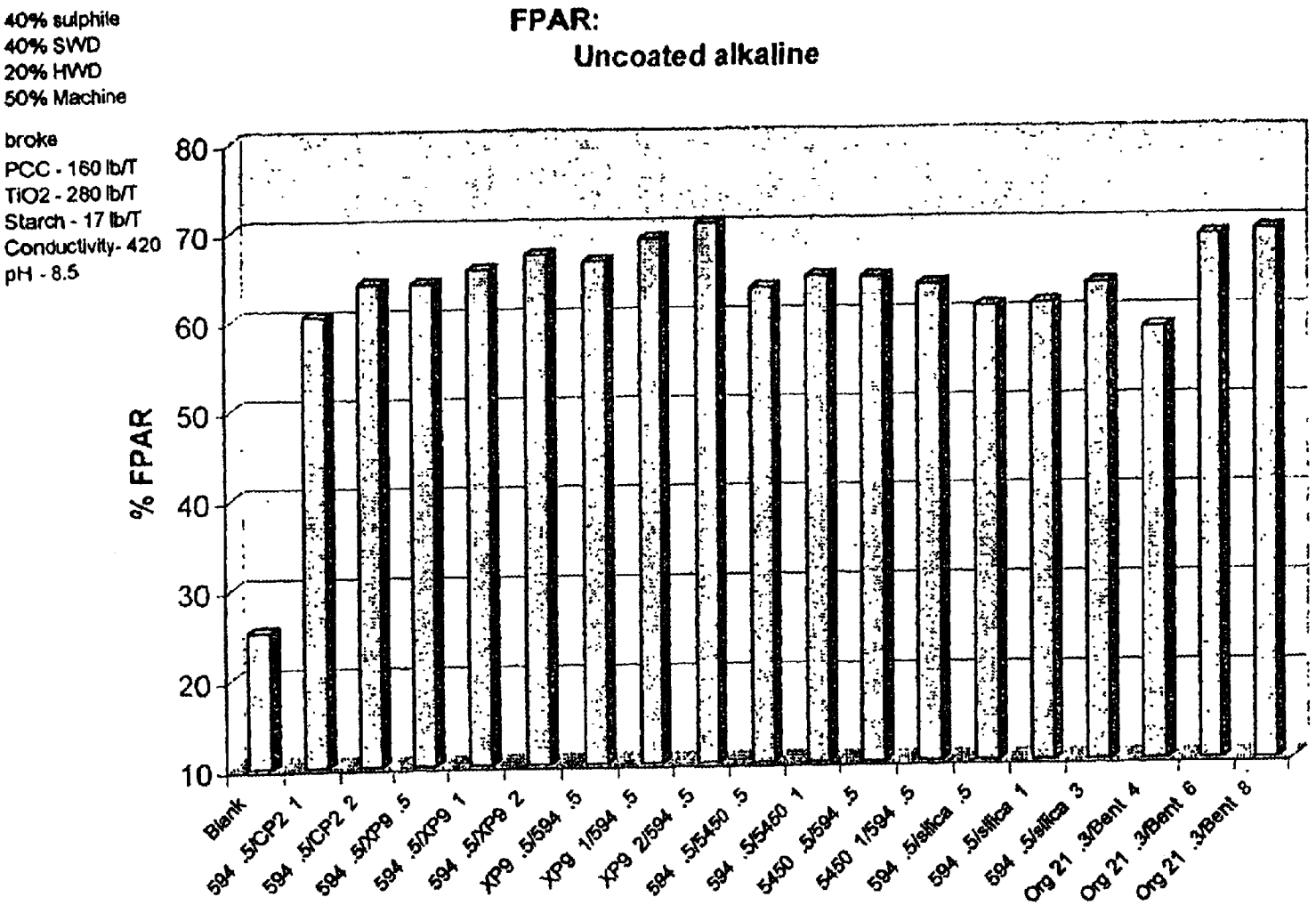
FIG. 18 is a bar graph showing the % FPAR of various exemplary and comparative paperstock formulations.

At paper mill 3, various examples were tested using a paperstock having an Hb conductivity of 420 and a pH of 8.5. The grade of the paperstock was a 20 pound weight grade of Snowland bible paper. The components of the various examples are shown in the attached FIGS. 17 and 18 as are the compositions of the paperstocks and additives provided for all examples on paper mill 3. The additives used in paper mill 3 and graphically reported in FIGS. 17 and 18 include PCC added in an amount of 160 pounds per ton, $TiO_2$ added in an amount of 280 pounds per ton, HERCON 79 added in an amount of 7.8 pounds per ton, and CATO 232 starch added in an amount of 17 pounds per ton, with all amounts being based on a dry basis and on the dried solids weight of the paperstock. In addition, BUFLOC® 594 was added before the screens in an amount of 0.5 pound per ton and POLYFLEX CP2™ was added in an amount of 0.98 pound per ton before the screens.

Figure 19:
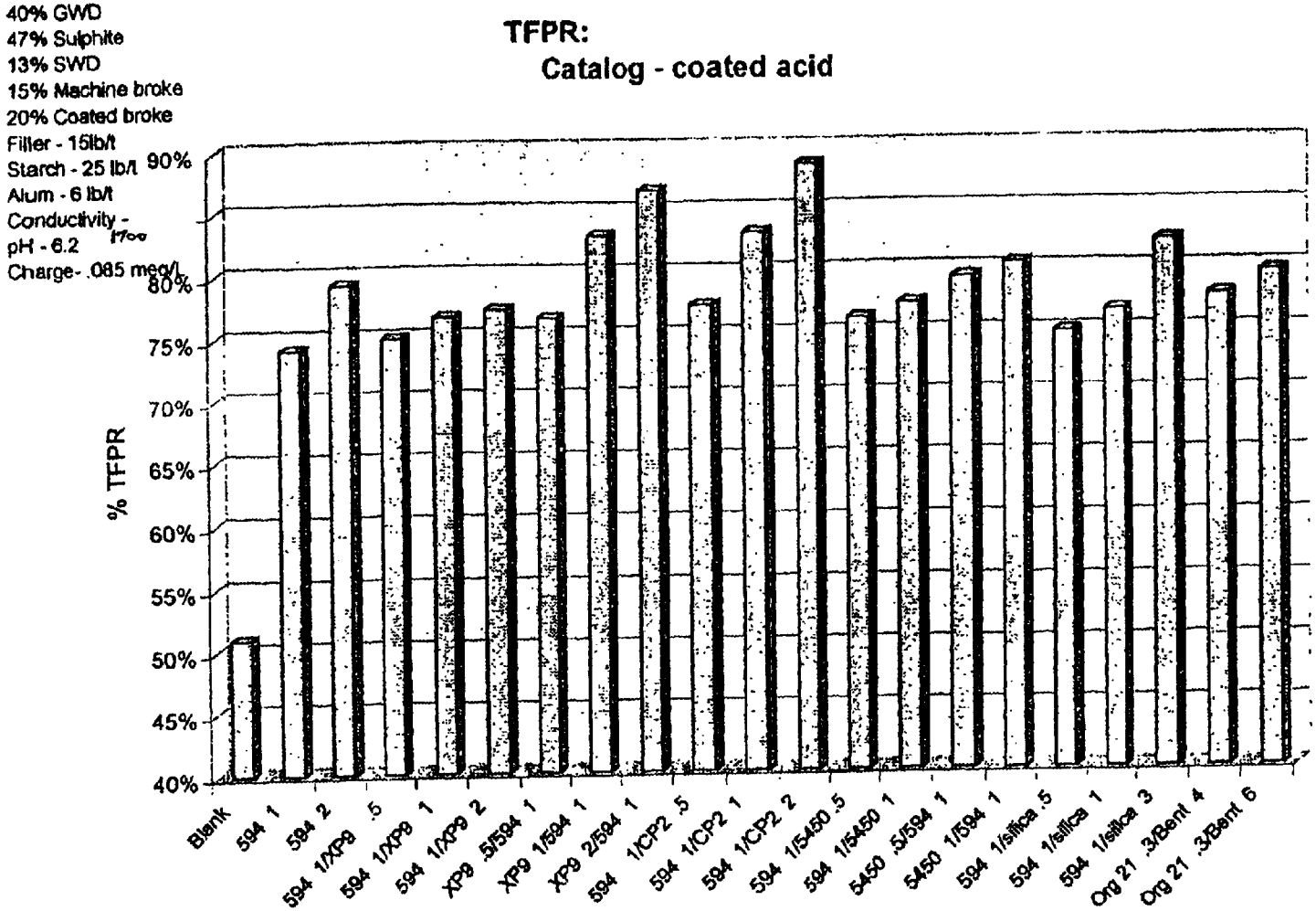
FIG. 19 is a bar graph showing the % TFPR of various exemplary and comparative paperstock formulations.
Figure 20:
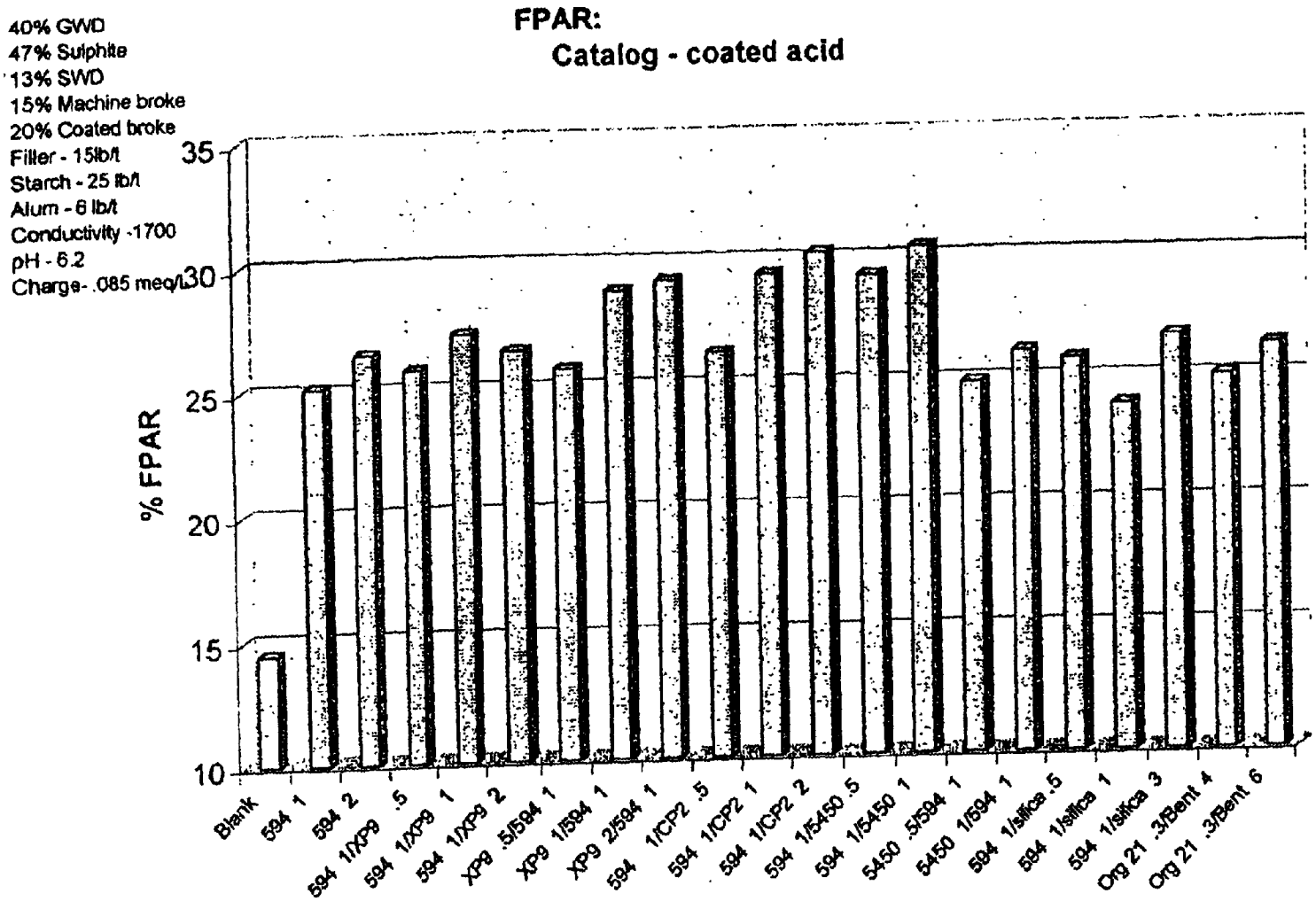
FIG. 20 is a bar graph showing the % FPAR of various exemplary and comparative paperstock formulations.

On paper mill number 4, a paperstock having the composition and properties described in FIGS. 19 and 20 was modified and tested. A HYDREX additive was added to the paperstock in an amount of 15 pounds per ton of paperstock before the primary fan pump. A CATO 15A starch was added to the paperstock in an amount of 25 pounds per ton of paperstock at the machine chest. At the blend chest, alum was added in an amount of 6 pounds per ton of paperstock and V-BRITE was added in an amount of 20 pounds per ton of paperstock. After the screens, ACCURAC 182 was added in an amount of 0.28 pound per ton of paperstock. All additions were on a dry basis and each ton of paperstock was based on the dried solids weight of the paperstock. The % TFPR for each of the examples tested and the composition of the retention system of each example tested are set forth in FIG. 19. The % FPAR and the compositions of each retention system of each example tested are shown in FIG. 20.

Figure 21:
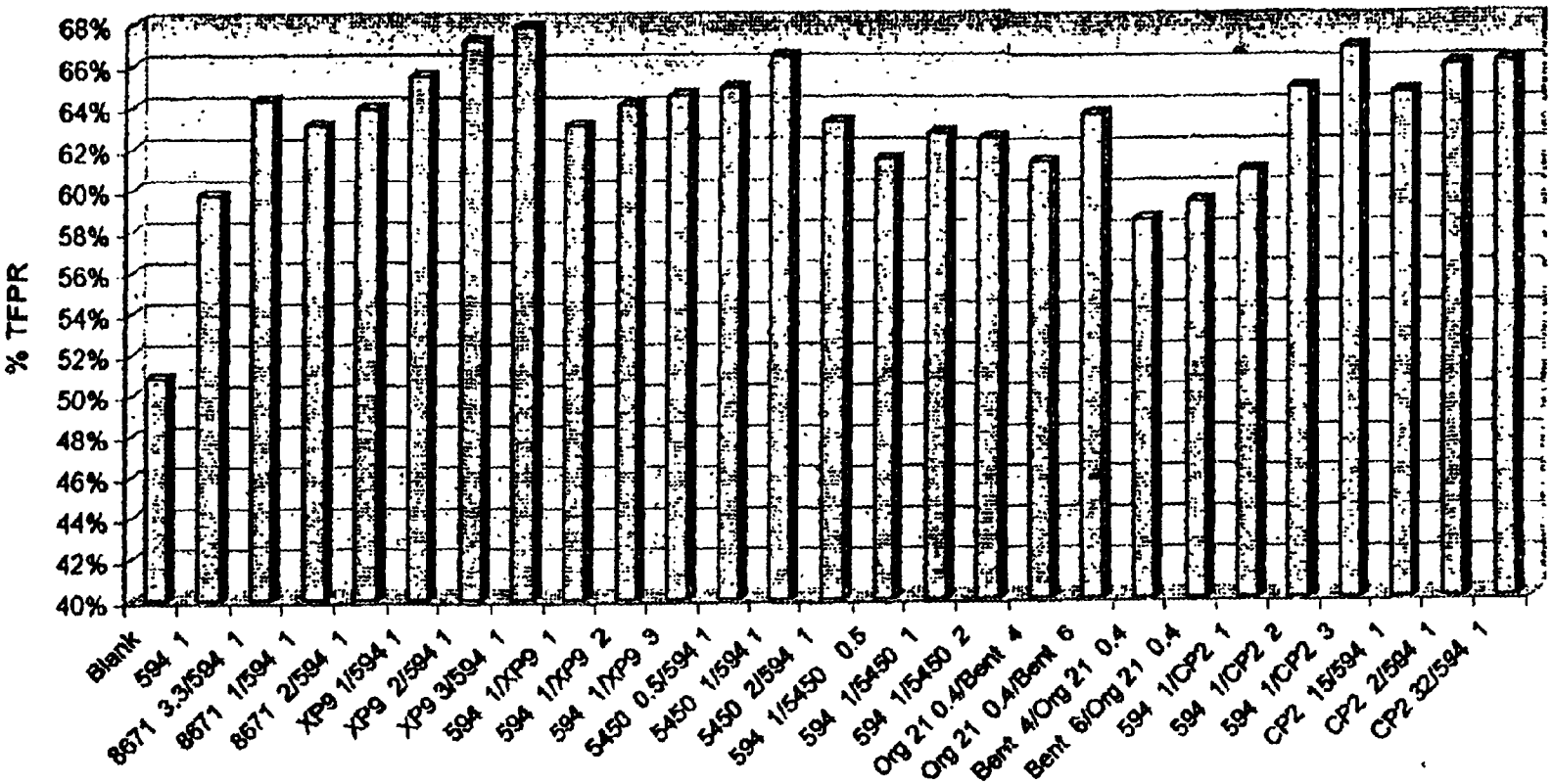
FIG. 21 is a bar graph showing the % TFPR of various exemplary and comparative paperstock formulations.
Figure 22:
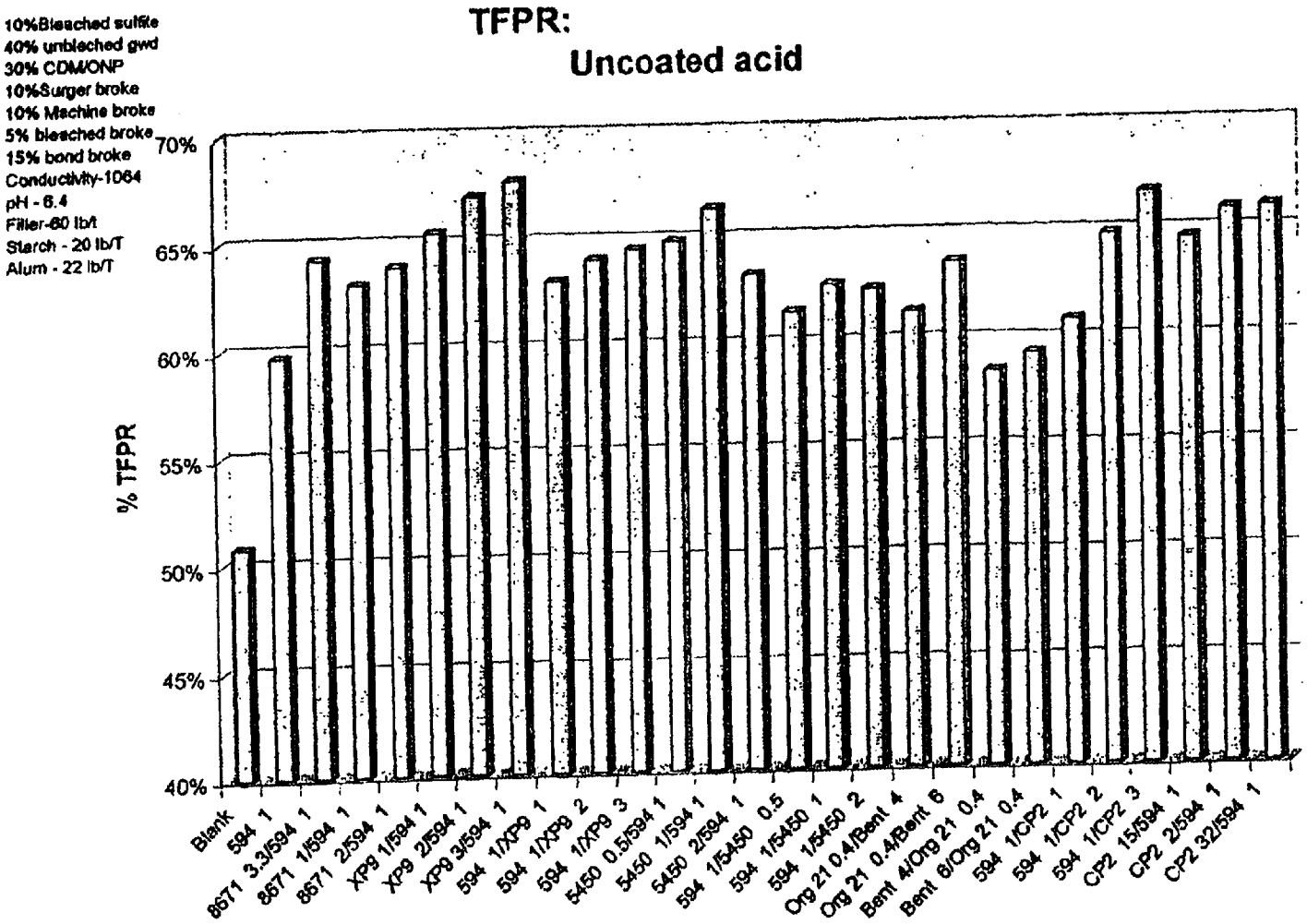
FIG. 22 is a bar graph showing the % TFPR of various exemplary and comparative paperstock formulations.
Figure 23:
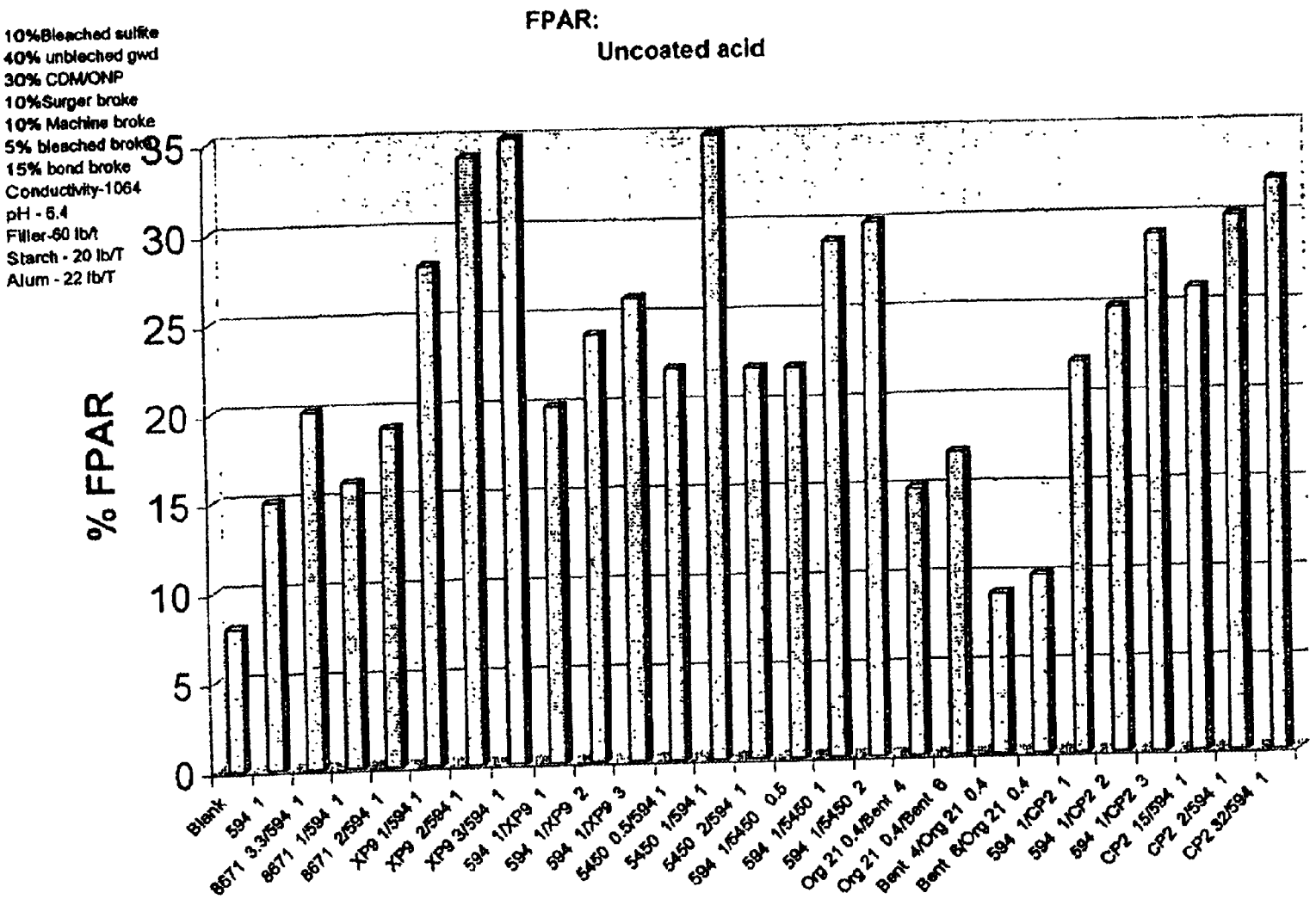
FIG. 23 is a bar graph showing the % FPAR of various exemplary and comparative paperstock formulations.

Testing was also conducted on an uncoated acid paper at paper mill 5. The results of retention tests conducted on the paperstock at paper mill 5 are reported in FIGS. 21–23. The composition of the paperstock tested and properties of the paperstock from which results are reported in each of FIGS. 21–23 are shown in FIGS. 22 and 23. As with other examples set forth herein, in instances such as the testing on paper mill number 5 wherein the various components of the paperstock add up to over 100%, the percentages are to be considered as parts by weight as opposed to percents by weight.

Additives combined with the paperstock on paper mill 5 included a HYDREX filler added in an amount of 60 pounds per ton of paperstock, a CATO 215 starch added in an amount of 20 pounds per ton of paperstock, alum added in an amount of 22 pounds per ton of paperstock, with all amounts being based on a dry basis and on the dried solids weight of the paperstock. After the screen, ACCURAC 182 (ACC 182) was added in an amount of 0.3 pound per ton of paperstock. Before the screen NALCO 8671 was added in an amount of 0.5 pound per ton of paperstock. At the end of the process but before the forming wire an additional 0.6 pound per ton of ACC 182 was added. The 0.3 pound per ton addition of ACC 182 was equivalent to an addition of 0.94 wet pound of the product. The addition of the 0.5 pound per ton of NALCO 8671 was equivalent to an addition of 3.3 wet pounds of the product. The final addition of the 0.6 pound per ton of the ACC 182 was equivalent to an addition of 1.9 wet pounds of the product.

Example III

The performance of the OCTASOL microparticles as a retention aid was tested against comparative microparticle technologies in alkaline fine paper.

Procedure

Drainage and retention were performed using a small screen through which 700 ml samples were drained. Mixing was carried out in a food blender. 700-ml samples were used for both drainage and retention.

A Britt Jar test was performed at 750 rpm.

Drainage was performed using a modified Schopper Riegler.

| | |
|---|---|
| Furnish used: 70% HWD<br>30% SWD<br>Chemicals added to furnish:<br>5 lb. Cationic starch (Sta-lock 400) per ton of dried solids. | Freeness aprox. 450<br>pH 8.3<br>30% PCC |

Polymer addition was constant at 1 pound per ton of paperstock based on the dried solids weight of both the polymer and the paperstock.

OCTASOL dosage for this test was calculated on an as received basis (a 15 wt % solution of microparticles).

Figure 24:
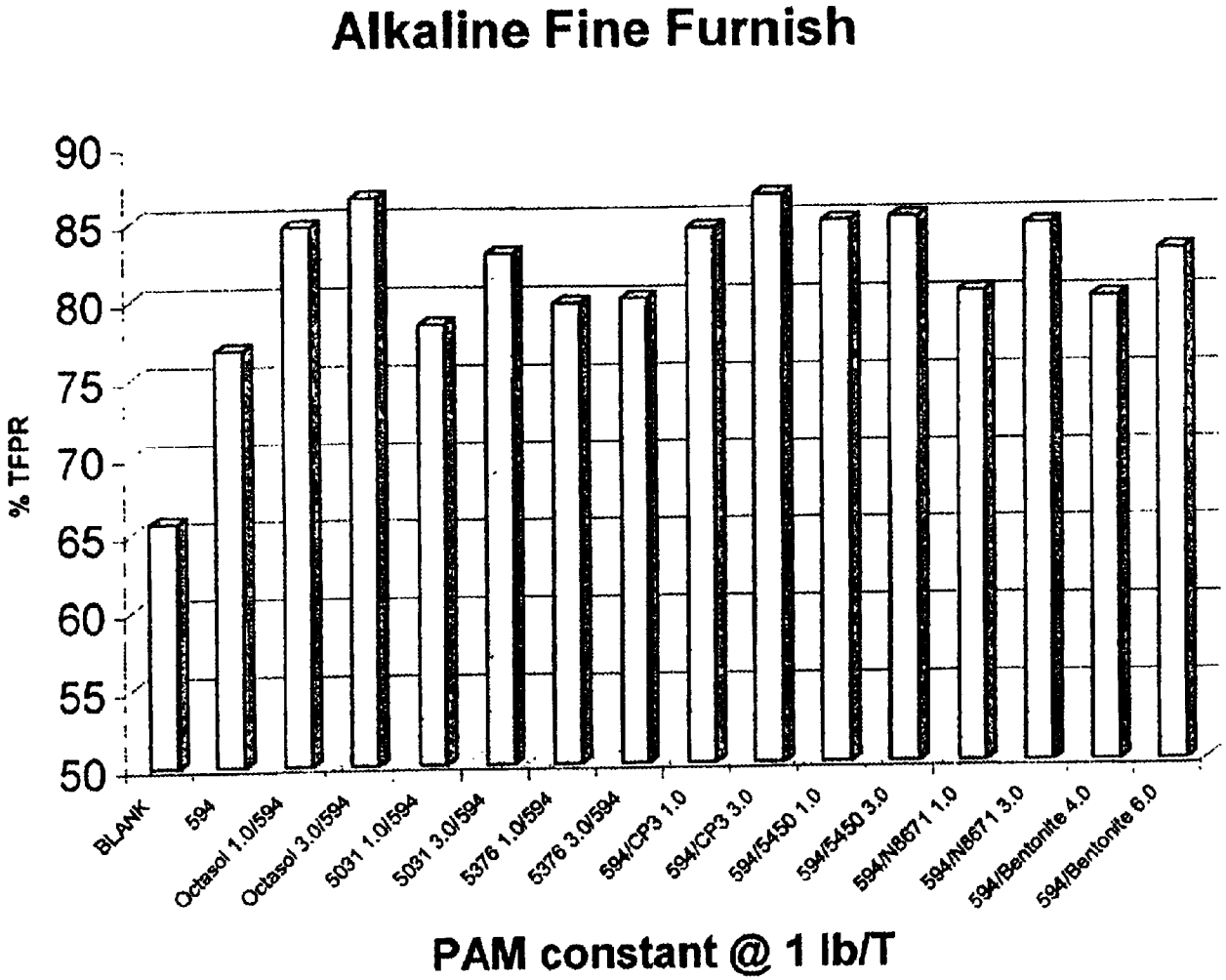
FIG. 24 is a bar graph showing the % TFPR of various exemplary and comparative paperstock formulations.
Figure 25:
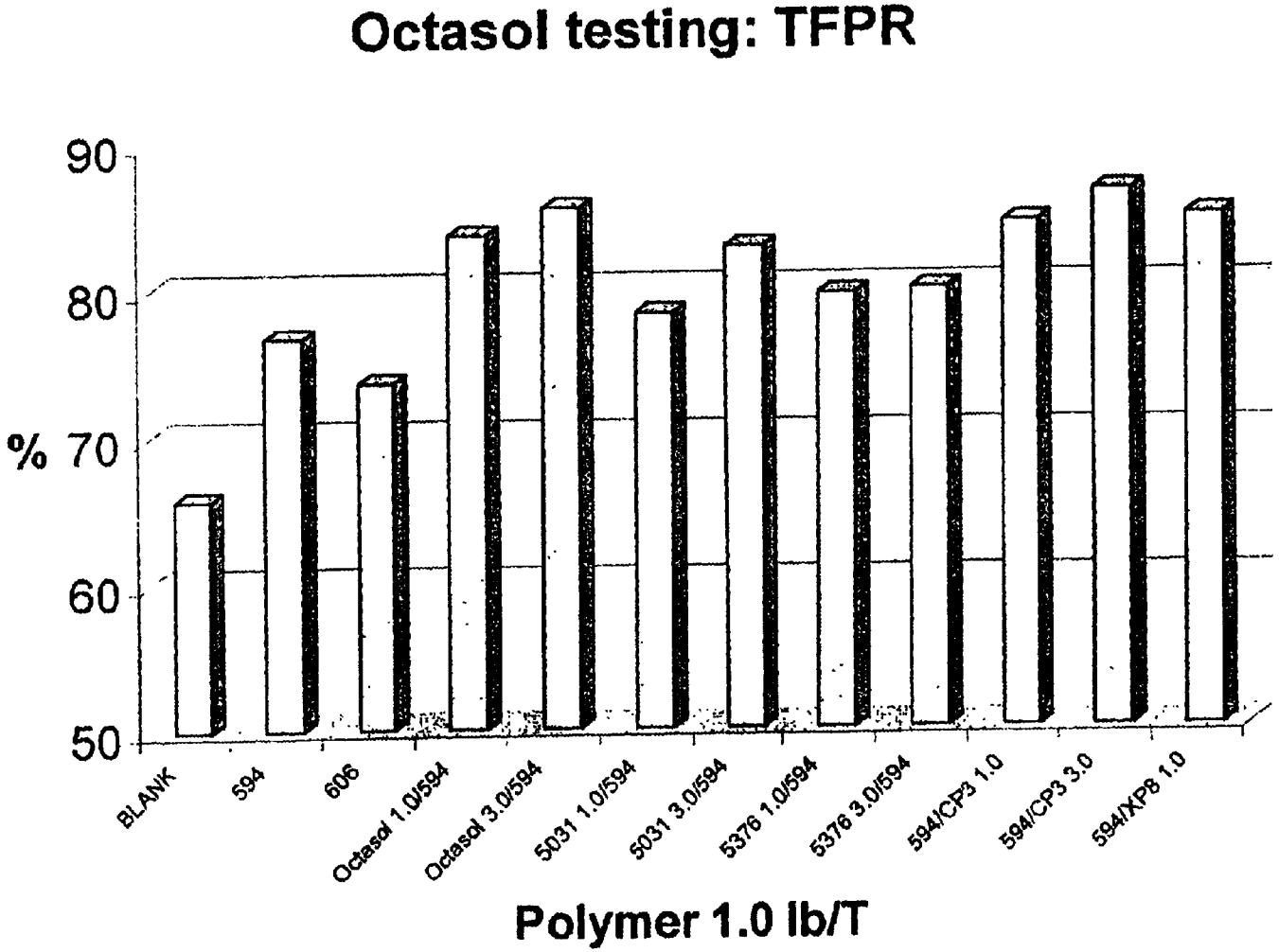
FIG. 25 is a bar graph showing the % TFPR of various exemplary and comparative paperstock formulations.
Figure 26:
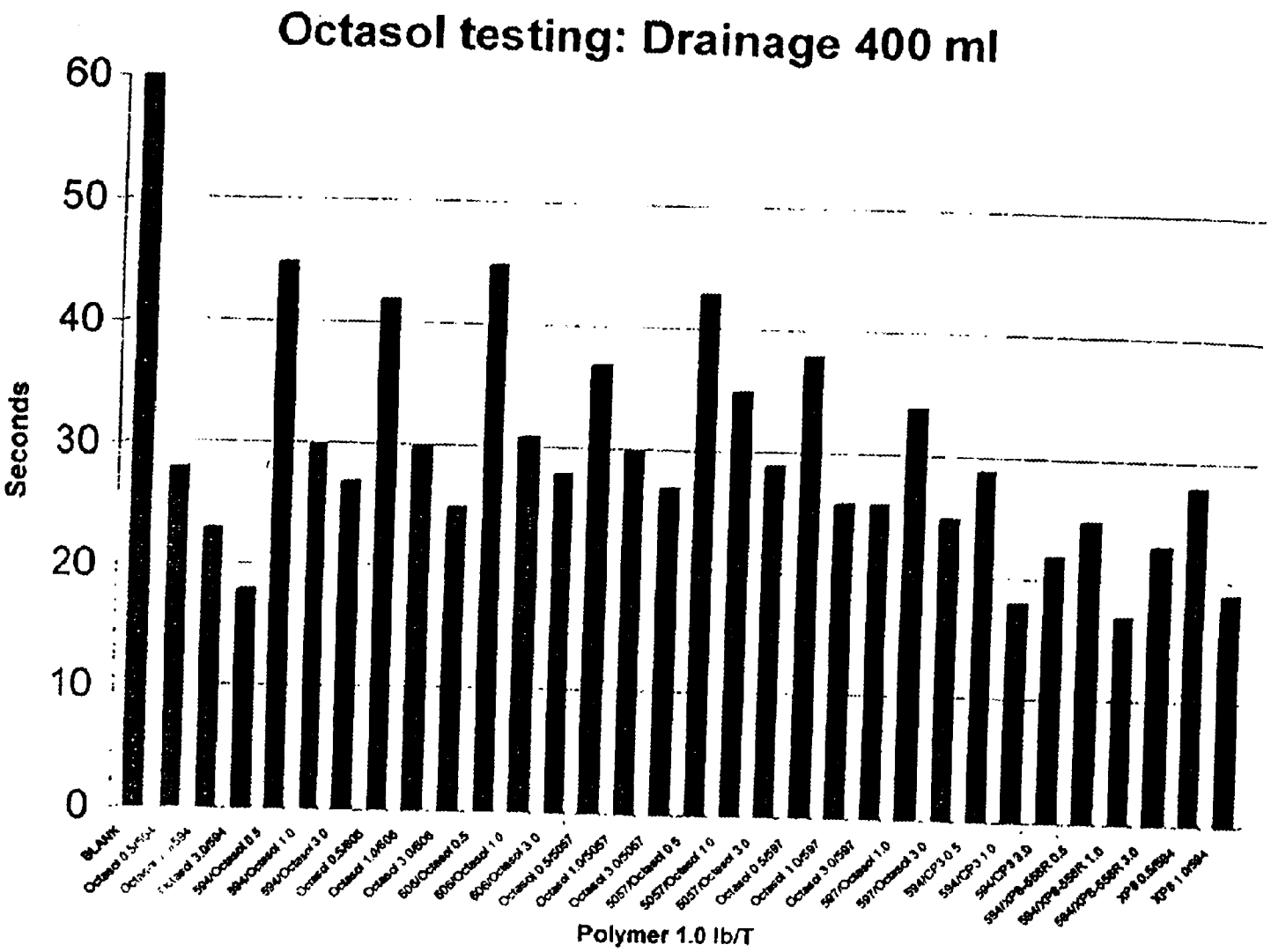
FIG. 26 is a bar graph showing the seconds required to drain 400 ml of filtrate from paperwebs made from various exemplary and comparative paperstock formulations.

An alkaline fine paperstock (furnish) was tested on paper mill 6 and the drainage time required to collect 200, 300, and 400 ml, respectively, of filtrate was measured. The % TFPR values of many different examples are reported graphically in FIGS. 24 and 25. The drainage time in seconds to collect 400 ml of filtrate is reported for many different examples in FIG. 26. The data used to achieve the graphical results shown in FIGS. 24–26 is reported in Tables 9–12 below.

TABLE 9

| OCTASOL TESTING Alkaline fine furnish | | | |
|---|---|---|---|
| Polymer dosage constant @ 1 lb/T | 200 | 300 | 400 |
| BLANK | 8 | 12 | 60 |
| Octasol 0.5/594 | 4 | 8 | 28 |
| Octasol 1.0/594 | 4 | 9 | 23 |
| Octasol 3.0/594 | 4 | 8 | 18 |
| 594/Octasol 0.5 | 5 | 11 | 45 |
| 594/Octasol 1.0 | 4 | 10 | 30 |
| 594/Octasol 3.0 | 4 | 12 | 27 |
| Octasol 0.5/606 | 5 | 13 | 42 |
| Octasol 1.0/606 | 4 | 11 | 30 |
| Octasol 3.0/606 | 4 | 10 | 25 |
| 606/Octasol 0.5 | 4 | 15 | 45 |
| 606/Octasol 1.0 | 4 | 13 | 31 |
| 606/Octasol 3.0 | 4 | 12 | 28 |
| Octasol 0.5/5057 | 4 | 9 | 37 |
| Octasol 1.0/5057 | 4 | 10 | 30 |
| Octasol 3.0/5057 | 4 | 11 | 27 |
| 5057/Octasol 0.5 | 4 | 11 | 43 |
| 5057/Octasol 1.0 | 4 | 11 | 35 |
| 5057/Octasol 3.0 | 4 | 10 | 29 |
| Octasol 0.5/597 | 4 | 9 | 38 |
| Octasol 1.0/597 | 4 | 11 | 26 |
| Octasol 3.0/597 | 4 | 10 | 26 |
| 597/Octasol 1.0 | 4 | 12 | 34 |
| 597/Octasol 3.0 | 4 | 11 | 25 |
| 594/CP3 0.5 | 4 | 9 | 29 |
| 594/CP3 1.0 | 4 | 7 | 18 |
| 594/CP3 3.0 | 4 | 10 | 22 |
| 594/XP8-558R 0.5 | 3 | 6 | 25 |
| 594/XP8-558R 1.0 | 3 | 6 | 17 |
| 594/XP8-558R 3.0 | 3 | 7 | 23 |
| XP8 0.5/594 | 3 | 8 | 28 |
| XP8 1.0/594 | 3 | 7 | 19 |

TABLE 10

| | TFPR |
|---|---|
| BLANK | 65.7 |
| 594 | 76.8 |
| Octasol 1.0/594 | 84.7 |
| Octasol 3.0/594 | 86.5 |
| 5031 1.0/594 | 78.4 |
| 5031 3.0/594 | 82.9 |
| 5376 1.0/594 | 79.7 |
| 5376 3.0/594 | 80 |
| 594/CP3 1.0 | 84.5 |
| 594/CP3 3.0 | 86.6 |
| 594/5450 1.0 | 84.9 |
| 594/5450 3.0 | 85.1 |
| 594/N8671 1.0 | 80.3 |
| 594/N8671 3.0 | 84.6 |
| 594/Bentonite 4.0 | 79.9 |
| 594/Bentonite 6.0 | 82.9 |

TABLE 11

| | |
|---|---|
| 594/Microfloc 1.0 | 92.8 |
| 594/Microfloc 3.0 | 95.7 |
| 5031 1.0/606 | 78.9 |
| 5031 3.0/606 | 81.2 |
| 5376 1.0/606 | 76.9 |
| 5376 3.0/606 | 80.8 |

TABLE 12

| | 200 | 300 | 400 |
|---|---|---|---|
| BLANK | 8 | 12 | 60 |
| Octasol 0.5/594 | 4 | 8 | 28 |
| Octasol 1.0/594 | 4 | 9 | 23 |
| Octasol 3.0/594 | 4 | 8 | 18 |
| 594/CP3 0.5 | 4 | 9 | 29 |
| 594/CP3 1.0 | 4 | 7 | 18 |
| 594/CP3 3.0 | 4 | 10 | 22 |
| 594/XP8-558R 0.5 | 3 | 6 | 25 |
| 594/XP8-558R 1.0 | 3 | 6 | 17 |
| 594/XP8-558R 3.0 | 3 | 7 | 23 |
| XP8 0.5/594 | 3 | 8 | 28 |
| XP8 1.0/594 | 3 | 7 | 19 |

Comparable results were obtained using the combination of BUFLOC® 594 with the fibrous cationic colloidal alumina microparticles compared with the current microparticle technologies available and tested.

Better performance was obtained using a cationic polyacrylamide (PAM) in combination with the OCTASOL compared to using an anionic or a non-ionic PAM. Adding the OCTASOL prior to the PAM proved to be much more effective.

The method and apparatus of the present invention provide excellent drainage and/or retention of fines. Resulting paper and paperboard made according to the method of the present invention exhibit excellent opaqueness and other desirable physical properties.

It will be apparent to those skilled in the art that various modifications and variations can be made to the embodiments of the present invention without departing from the spirit or scope of the present invention. Thus, it is intended that the present invention covers other modifications and variations of this invention within the scope of the appended claims and their equivalents.

What is claimed is:

1. A method of making paper or paperboard comprising:

introducing fibrous cationic colloidal alumina microparticles to a papermaking pulp and introducing at least one polymer to said papermaking pulp, to form a treated pulp, said polymer comprising a cationic polymer, a nonionic polymer, or an amphoteric polymer under cationic conditions or combinations thereof, wherein said polymer is a drainage polymer, retention polymer, or both; and forming the treated pulp into paper or paperboard, wherein said fibrous cationic colloidal alumina microparticles are added to said papermaking pulp prior to introducing said polymer to said pulp.

2. The method of claim 1, wherein said fibrous cationic colloidal alumina microparticles comprise a fibrous cationic acetate salt of boehmite alumina having a zeta potential of greater than about 25 and a weight ratio of aluminum to acetate of less than about 4.

3. The method of claim 1, wherein said fibrous cationic colloidal alumina microparticles comprise a cationic fibrous acetate salt of boehmite alumina.

4. The method of claim 1, wherein said fibrous cationic colloidal alumina microparticles contain from about 0.5% by weight to about 30% by weight $Al_2O_3$.

5. The method of claim 1, wherein said fibrous cationic colloidal alumina microparticles are added to said pulp in an amount of at least about 0.05 pound on a dry basis, per ton of pulp based on the dried solids weight of the pulp.

6. The method of claim 1, wherein said fibrous cationic colloidal alumina microparticles are added to said pulp in an amount of from about 0.3 pound to about 5.0 pounds on a dry basis, per ton of pulp based on the dried solids weight of the pulp.

7. The method of claim 1, wherein said cationic polymer is present and comprises a synthetic nitrogen-containing cationic polymer.

8. The method of claim 1, wherein said cationic polymer is present and comprises a cationic polyacrylamide.

9. The method of claim 1, wherein said fibrous cationic coiloidal alumina microparticles and said polymer are introduced to said papermaking pulp at about the same time.

10. The method of claim 1, further comprising combining at least one cationic starch with said papermaking pulp prior to introducing said fibrous cationic colloidal alumina microparticles to said pulp.

11. The method of claim 1, wherein said pulp comprises a sulfite pulp.

12. The method of claim 1, wherein said polymer is a synthetic, water-soluble cationic polymer containing acrylamide units and cationic monomeric units.

13. The method of claim 1, further comprising adding at least one cellulytic enzyme to said pulp.

14. The method of claim 1, further comprising adding at least one cellulytic enzyme to said pulp before introducing said fibrous cationic colloidal alumina microparticles to said pulp.

15. A paper or paperboard made according to the method of claim 1.

16. A paper or paperboard made from a drained paperweb, said paperweb comprising a treated pulp, said treated pulp comprising cellulosic fibers, fibrous cationic colloidal alumina microparticles, and at least one retention system polymer, said retention system polymer comprising a cationic polymer, a nonionic polymer, or an amphoteric polymer under cationic conditions, or combinations thereof, wherein said paper or paperboard is made by the method of claim 1.

17. The paper or paperboard of claim 16, wherein said fibrous cationic colloidal alumina microparticles comprise a fibrous cationic acetate salt of boehmite alumina having a zeta potential of greater than about 25 and a weight ratio of aluminum to acetate of less than about 4.

18. A papermaking apparatus comprising a supply of fibrous cationic colloidal alumina microparticles, a supply of a papermaking pulp, a device for feeding fibrous cationic colloidal alumina microparticles from the supply of fibrous cationic colloidal alumina microparticles to the supply of papermaking pulp, a supply of a retention system polymer, a device for feeding retention system polymer from the supply of retention system polymer to the pulp or treated pulp, wherein the supply of fibrous cationic colloidal alumina microparticles is located upstream from the supply of the retention system polymers, and a device for forming the pulp into a paper or paperboard after treatment with said fibrous cationic colloidal alumina microparticles and said retention system polymer, wherein said retention system polymer is a cationic polymer, a nonionic polymer, or an amphoteric polymer under cationic conditions, or combinations thereof.

19. The apparatus of claim 18, wherein said device for forming the pulp comprises a blend chest in communication with said supply of treated pulp, a fan pump in communication with the blend chest, a screen in communication with said fan pump, and a head box in communication with said screen.

20. The apparatus of claim 19, wherein a supply tank is provided for holding a supply of the pulp, and the communication between said supply tank and said blend chest includes a refining apparatus for refining the pulp before entering the blend chest.

21. The apparatus of claim 19, further comprising a white water silo, wherein said white water silo has an inlet in communication with said blend chest, an inlet in communication with said head box, and an outlet in communication with said fan pump.

22. The apparatus of claim 21, further comprising one or more refiners for refining the pulp prior to forming the pulp in said head box.

* * * * *

UNITED STATES PATENT AND TRADEMARK OFFICE

CERTIFICATE OF CORRECTION

PATENT NO. : 6,770,170 B2
DATED : August 3, 2004
INVENTOR(S) : Covarrubias

It is certified that error appears in the above-identified patent and that said Letters Patent is hereby corrected as shown below:

Column 19,
Line 18, "coiloidal" should read -- colloidal --.

Signed and Sealed this

Sixteenth Day of November, 2004

JON W. DUDAS
*Director of the United States Patent and Trademark Office*